US007338321B2

(12) United States Patent
Laurx

(10) Patent No.: US 7,338,321 B2
(45) Date of Patent: Mar. 4, 2008

(54) HIGH-DENSITY, ROBUST CONNECTOR WITH GUIDE MEANS

(75) Inventor: John C. Laurx, Aurora, IL (US)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 11/395,033

(22) Filed: Mar. 31, 2006

(65) Prior Publication Data

US 2007/0021000 A1 Jan. 25, 2007

Related U.S. Application Data

(60) Provisional application No. 60/666,971, filed on Mar. 31, 2005.

(51) Int. Cl.
*H01R 13/648* (2006.01)
*H01R 13/64* (2006.01)

(52) U.S. Cl. ..... 439/608; 439/378

(58) Field of Classification Search ..... 439/608, 439/701, 378
See application file for complete search history.

(56) References Cited

U.S. PATENT DOCUMENTS 3,456,231 A 7/1969 Paullus et al.
3,576,520 A 4/1971 Stauffer
4,032,209 A 6/1977 Rutkowski
4,655,518 A 4/1987 Johnson et al.
4,776,811 A * 10/1988 Humphrey ..... 439/378
4,797,123 A 1/1989 Weber
4,820,169 A 4/1989 Weber
4,871,321 A 10/1989 Johnson
5,443,398 A * 8/1995 Ortega ..... 439/378
5,584,728 A 12/1996 Cheng
5,605,476 A 2/1997 McNamara et al.
5,672,064 A 9/1997 Provencher et al.
5,702,258 A 12/1997 Provencher et al.
5,785,537 A 7/1998 Donahue et al.
6,010,373 A 1/2000 Donahue
6,123,554 A * 9/2000 Ortega et al. ..... 439/79
6,149,447 A 11/2000 Maeda et al.
6,227,894 B1 5/2001 Maeda et al.
6,231,391 B1 * 5/2001 Ramey et al. ..... 439/608
6,582,250 B2 6/2003 Taylor et al.
6,626,692 B2 9/2003 Maeda et al.
6,716,045 B2 * 4/2004 Meredith ..... 439/608
2007/0021001 A1 1/2007 Laurx et al.
2007/0021002 A1 1/2007 Laurx et al.
2007/0021003 A1 1/2007 Laurx et al.
2007/0021004 A1 1/2007 Laurx et al.

* cited by examiner

*Primary Examiner*—Briggitte R. Hammond
(74) *Attorney, Agent, or Firm*—Thomas D. Paulius

(57) ABSTRACT

A high speed connector includes a plurality of wafer-style components in which two columns of conductive terminals are supported in an insulative support body, the body including an internal cavity disposed between the two columns of conductive terminals. The terminals are arranged in horizontal pairs, and the internal cavity defines an air channel between each horizontal pair of terminals arranged in the two columns of terminals. The terminals are further aligned with each other in each row so that horizontal faces of the terminals in the two rows face each other to thereby promote broadside coupling between horizontal pairs of terminals. Guide members are provided and are attached to the components to provide a means for guiding the components into engagement with opposing connectors.

12 Claims, 26 Drawing Sheets

FIG.4A
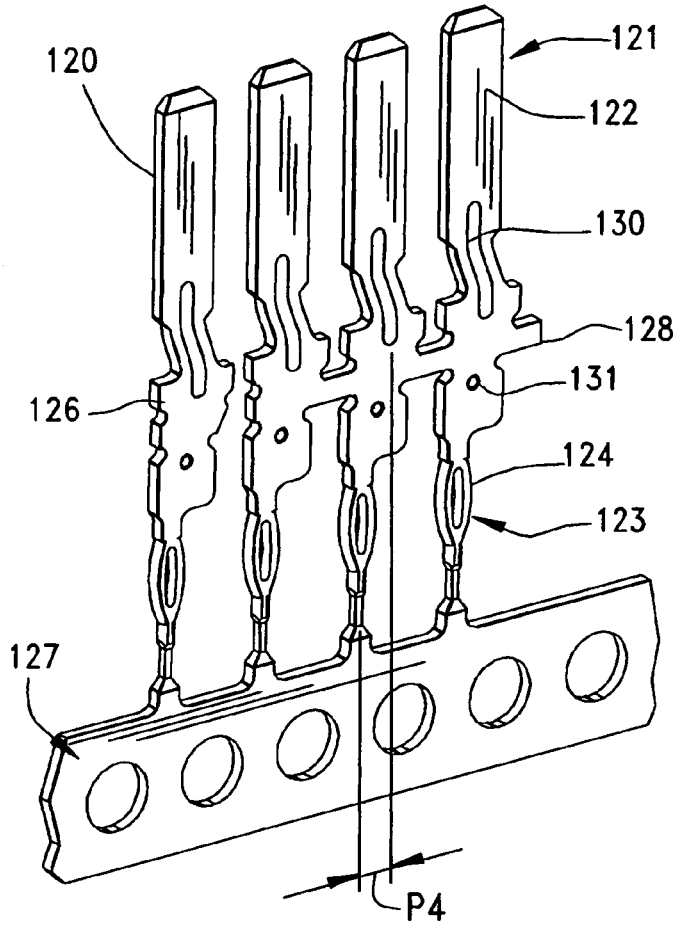
FIG.4B
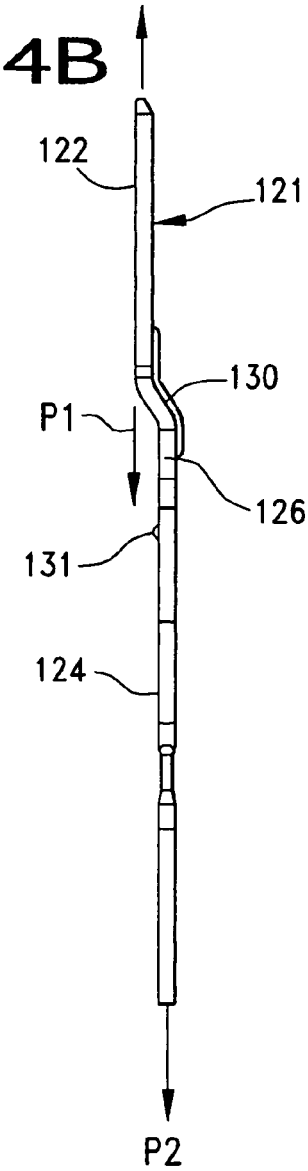
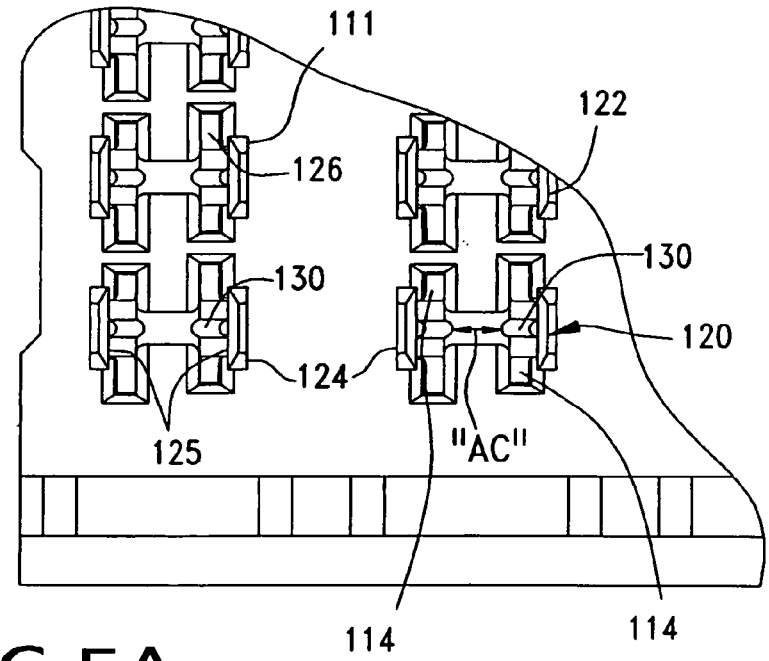
FIG.5A

FIG.5B
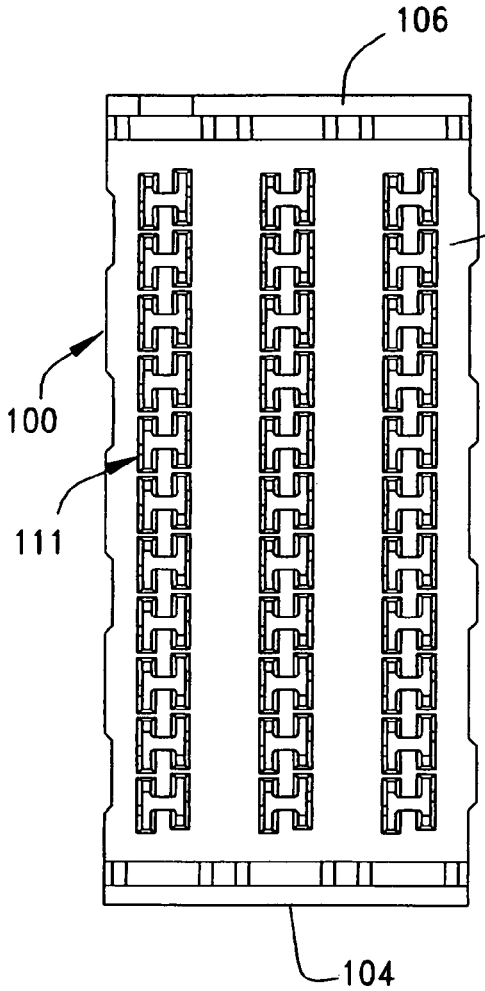
FIG.5D
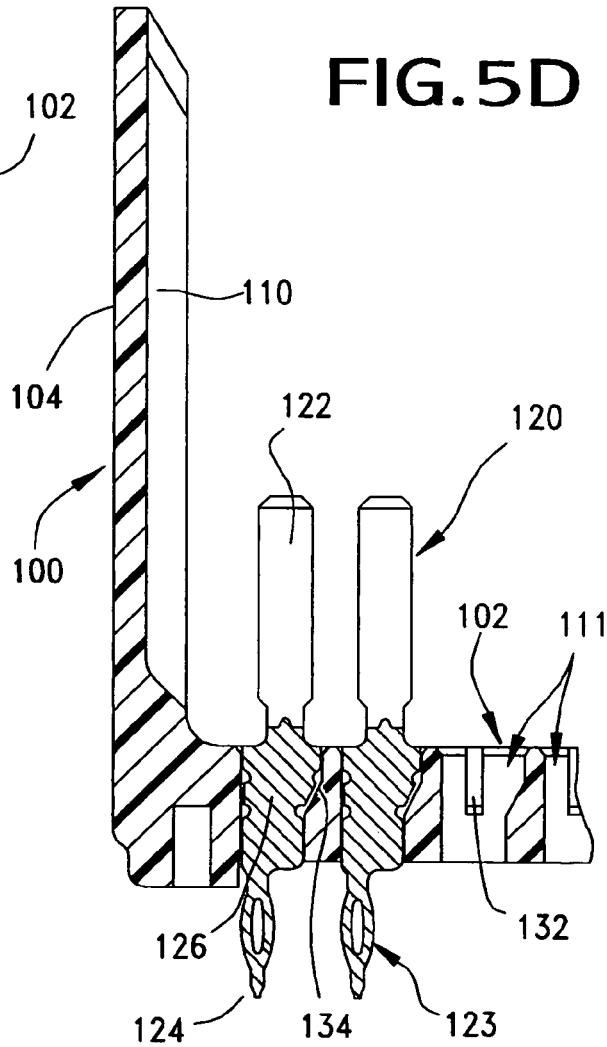
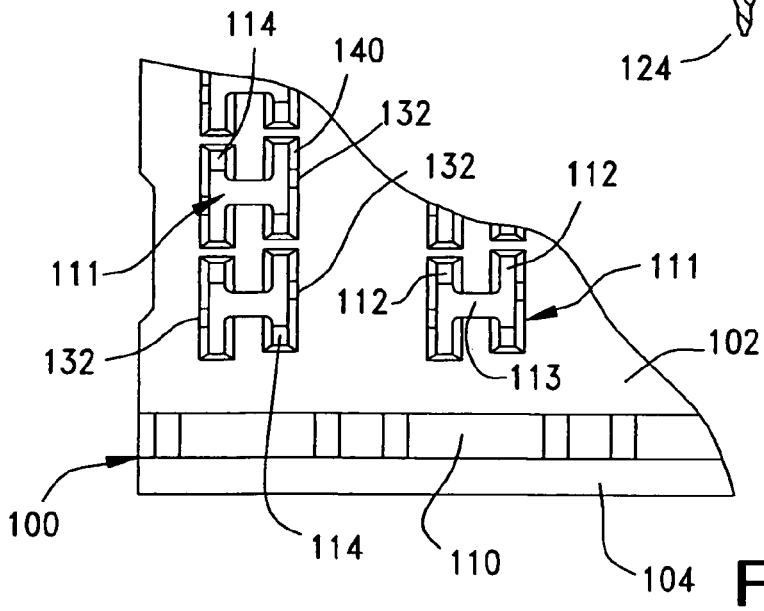
FIG.5C 454
452
450
A
B
C
D
E
F
454
454
454
452
454
454
454

HIGH-DENSITY, ROBUST CONNECTOR WITH GUIDE MEANS

REFERENCE TO RELATED APPLICATIONS

This application claims priority of prior U.S. Provisional Patent Application No. 60/666,971, filed Mar. 31, 2005.

BACKGROUND OF THE INVENTION

The present invention pertains generally to electrical connectors, and more particularly to an improved connector suitable for use in backplane applications.

Backplanes are large circuit boards that contain various electrical circuits and components. They are commonly used in servers and routers in the information and technology areas. Backplanes are typically connected to other backplanes or to other circuit boards, known as daughter boards, which contain circuitry and components. Data transfer speeds for backplanes have increased as backplane technology has advanced. A few years ago, data transfer speeds of 1 Gigabit per second (Gb/s) were considered fast. These speeds have increased to 3 Gb/s to 6 Gb/s and now the industry is expecting speeds of 12 Gb/s and the like to be implemented in the next few years At high data transfer speeds, differential signaling is used and it is desirable to reduce the crosstalk and skew in such test signal applications to as low as possible in order to ensure correct data transfer. As data transfer speeds have increased, so has the desire of the industry to reduce costs. High speed signal transfer has in the past required the differential signal terminals to be shielded and this shielding increased the size and cost of backplane connectors because of the need to separately form individual shields that were assembled into the backplane connector.

These shields also increased the robustness of the connectors so that if the shields were to be eliminated, the robustness of the connector needed to be preserved. The use of shields also added additional cost in the manufacture and assembly of the connectors and because of the width of the separate shield elements, the overall relative size of a shielded backplane connector was large.

The present invention is directed to an improved backplane connector that is capable of high data transfer speeds, that eliminates the use of individual shields and that is economical to produce and which is robust to permit numerous cycles of engagement and disengagement.

SUMMARY OF THE INVENTION

It is therefore a general object of the present invention to provide a new backplane connector for use in next generation backplane applications.

Another object of the present invention is to provide a connector for use in connecting circuits in two circuit boards together that has a high terminal density, high speed with low crosstalk and which is robust.

A further object of the present invention is to provide a connector for use in backplane applications in which the connector includes a plurality of conductive terminals arranged in rows and in which the rows comprise either signal or ground terminals and which are held in a support structure that permits the connector to be used in right angle and orthogonal mating applications.

Yet another object of the present invention is to provide a backplane connector assembly that includes a backplane header component and a wafer connector component that is matable with the backplane header component, the backplane header component having a base that sits on a surface of a backplane and two sidewalls extending therefrom on opposite ends defining a channel into which the wafer connector component fits, the backplane header component including a plurality of conductive terminals, each of the terminals including a flat contact blade portion, a compliant tail portion and a body portion interconnecting the contact and tail portions together so that they are offset from each other, the backplane header component including slots associated with terminal-receiving cavities thereof, the slots providing air gaps, or channels, between the terminals through the backplane header component.

An additional object of the present invention is to provide a wafer connector component in which two columns of conductive terminals are supported in an insulative support body, the body including an internal cavity disposed between the two columns of conductive terminals, the terminal being arranged in horizontal pairs of terminal, the cavity defining an air channel between each horizontal pair of terminals arranged in the two columns of terminals, and the terminals being further aligned with each other in each row so that horizontal faces of the terminals in the two rows face each other to thereby promote broadside coupling between horizontal pairs of terminals.

It is yet another object of the presnet invention to provide a guide means for attachment to connectors of the invention, which guide means serve to orient the connectors into alignment with each other so as to prevent possible stubbing of the contact portions of the opposing connectors.

The present invention accomplishes these and other objects by way of its structure. In one principal aspect, the present invention includes a backplane connector component that takes the form of a pin header having a base and at least a pair with sidewalls that cooperatively define a series of slots, or channels, each of which receives the mating portion of a wafer connector component. The base has a plurality of terminal receiving cavities, each of which receives a conductive terminal. The terminals have flat control blades and compliant tails formed at opposite ends. These contact blades and tails are offset from each other and the cavities are configured to receive them. In the preferred embodiment, the cavities are shown as having an H-shape with each of the legs of the H-shaped cavities receiving one of the terminals and the interconnecting arm of the H-shaped cavity remaining open to define an air channel between the two terminals. Such an air channel is present between pairs of terminals in each row of terminals in the horizontal direction to effect broadside coupling between the pairs of terminals.

In another principal aspect of the present invention, a plurality of wafer connector components are provided that mate with the backplane header. Each such wafer connector component includes a plurality of conductive terminals that are arranged in two vertical columns (when viewed from the mating end thereof), and the two columns defining a plurality of horizontal rows of terminals, each row including a pair of terminals, and preferably a pair of differential signal terminals. The terminals in each of the wafer connector component rows are aligned broadside together so that capacitive coupling may occur between the pairs in a broadside manner. In order to regulate the impedance of each pair of terminals, each wafer connector component includes a structure that defines an internal cavity, and this internal cavity is interposed between the columns of terminals so that an air channel is present between each of the pairs of terminals in each wafer connector component.

In another principal aspect of the present invention, the contact portions of the wafer connector component terminals extend forwardly of the wafer and are formed as bifurcated contacts that have a cantilevered contact beam structure. An insulative housing, or cover member, may be provided for each wafer connector component and in such an instance, the housing engages the mating end of each wafer connector component in order to house and protect the contact beams. Alternatively, the cover member may be formed as a large cover member that accommodates a plurality of wafer connector elements.

In the preferred embodiment of the invention, theses housings or cover members have a U-shape with the legs of the U-shape engaging opposing top and bottom edges of the wafer connector component and the base of the U-shape providing a protective shroud to the contact beams. The base (of face, depending on the point of view) of the U has a series of I or H-shaped openings formed therein that are aligned with the contact portions of the terminals and these openings define individual air channels between the contact beams so that the dielectric constant of air may be used for broadside coupling between the terminal pairs through substantially the entire path of the terminals through the wafer connector component.

A guide member is provided that may be integrated with a header connector of the invention and another guide member maybe be provided as a separate member that is attacheable to the cover members of the connectors. These guide components may have posts and holes that serve to orient the connector and the header member together to reduce stubbing.

These and other objects, features and advantages of the present invention will be clearly understood through a consideration of the following detailed description.

BRIEF DESCRIPTION OF THE DRAWINGS

In the course of this detailed description, the reference will be frequently made to the attached drawings in which:

FIG. 4A is a perspective view of a series of terminals used in the backplane connector member of FIG. 4 and shown attached to a carrier strip to illustrate a manner in which they are formed;

FIG. 4B is a an end view of one of the terminals of FIG. 4A, illustrating the offset configuration of the terminal;

FIG. 5A is an enlarged plan view of a portion of the backplane member of FIG. 5, illustrating the terminals in place within the terminal-receiving cavities thereof;

FIG. 5B is the same plan view of the backplane member of FIG. 5, but with the terminal-receiving cavities thereof empty;

FIG. 5C is an enlarged plan view of a portion of FIG. 5B, illustrating the empty terminal-receiving cavities in greater detail;

FIG. 5D is a an enlarged detail sectional view of a portion of the backplane member illustrating two terminals of the type shown in FIG. 4A in place therein;

DETAILED DESCRIPTION OF THE PREFERRED EMBODIMENTS

Figure 1:
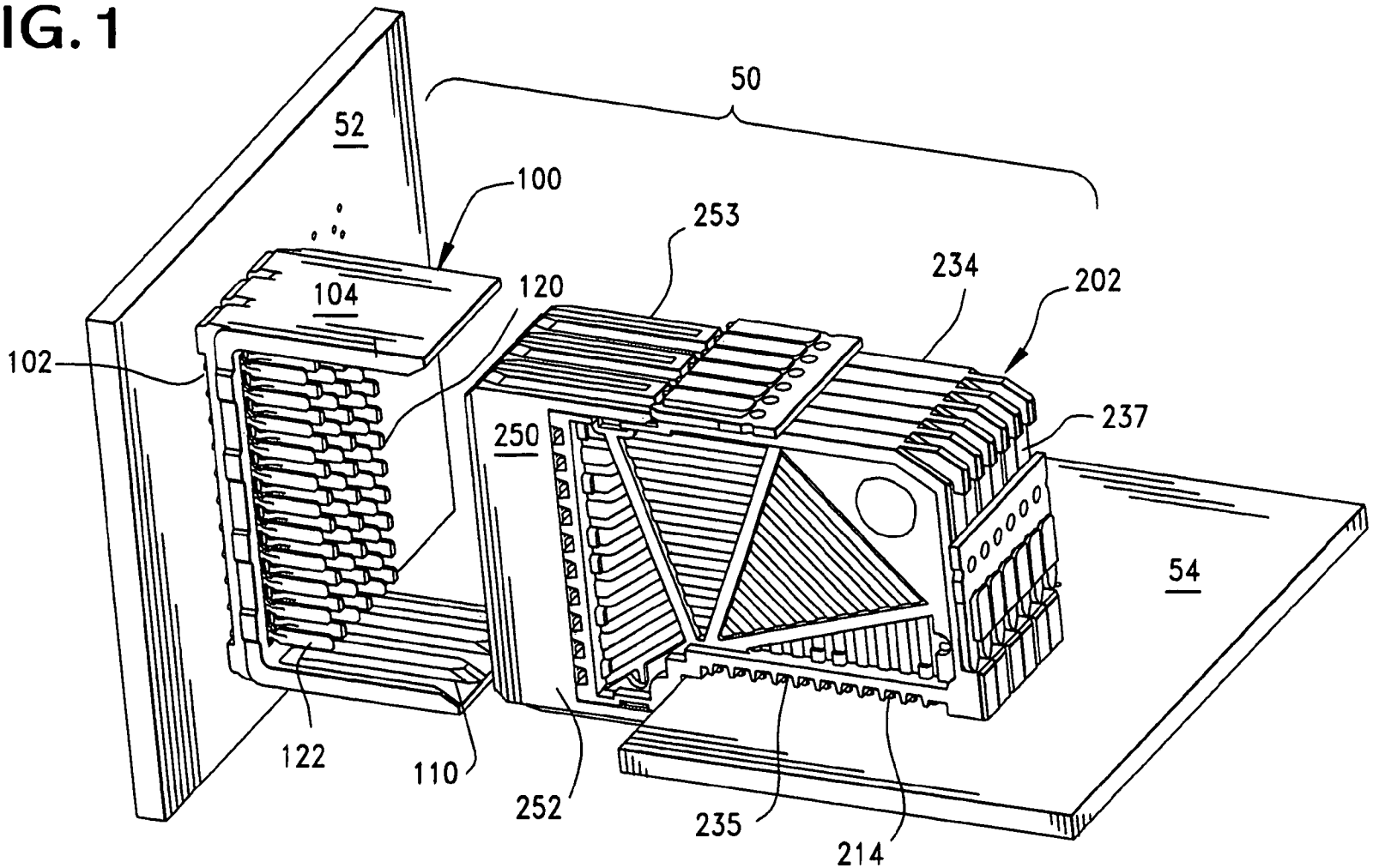
FIG. 1 is a perspective view of a backplane connector assembly constructed in accordance with the principles of the present invention and shown in a conventional right-angle orientation to join the electrical circuits on two circuit boards together.

FIG. 1 illustrates a backplane connector assembly 50 constructed in accordance with the principles of the present invention. The assembly 50 is used to join together two circuit boards 52, 54 with the circuit board 52 representing a backplane and the circuit board 54 representing an ancillary, or daughter board.

Figure 3:
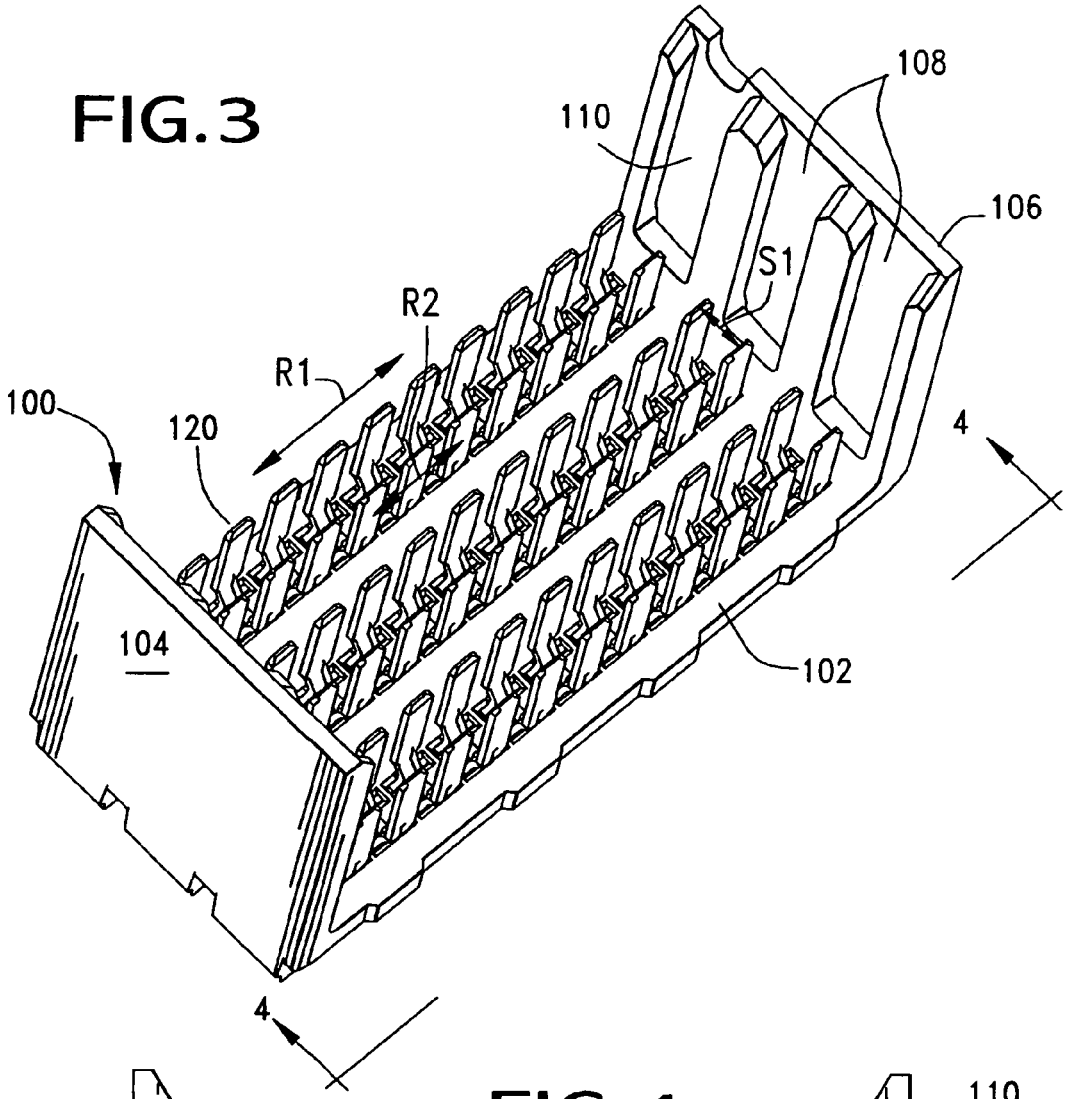
FIG. 3 is a perspective view of the backplane connector component of the backplane connector assembly of FIG. 1.

The assembly 50 can be seen to include two interengaging, or mating, components 100 and 200. One component 100 is mounted to the backplane board 52 and is a backplane member that takes the form of a pin header. In this regard, the backplane member 100, as illustrated best in FIGS. 1 and 3, includes a base portion 102 with two sidewalls 104, 106 rising up from the base portion 102. These two sidewalls 104, 106 serve to define a series of channels, or slots 108, each slot of which receives a single wafer connector component 202. In order to facilitate the proper orientation of the wafer connector components 202 within the backplane connector component, the sidewalls 104, 106 are preferably formed with interior grooves 110 that are vertically oriented and each such groove 110 is aligned with two rows R1, R2 of conductive terminals 120. (FIG. 3.)

Figure 4:
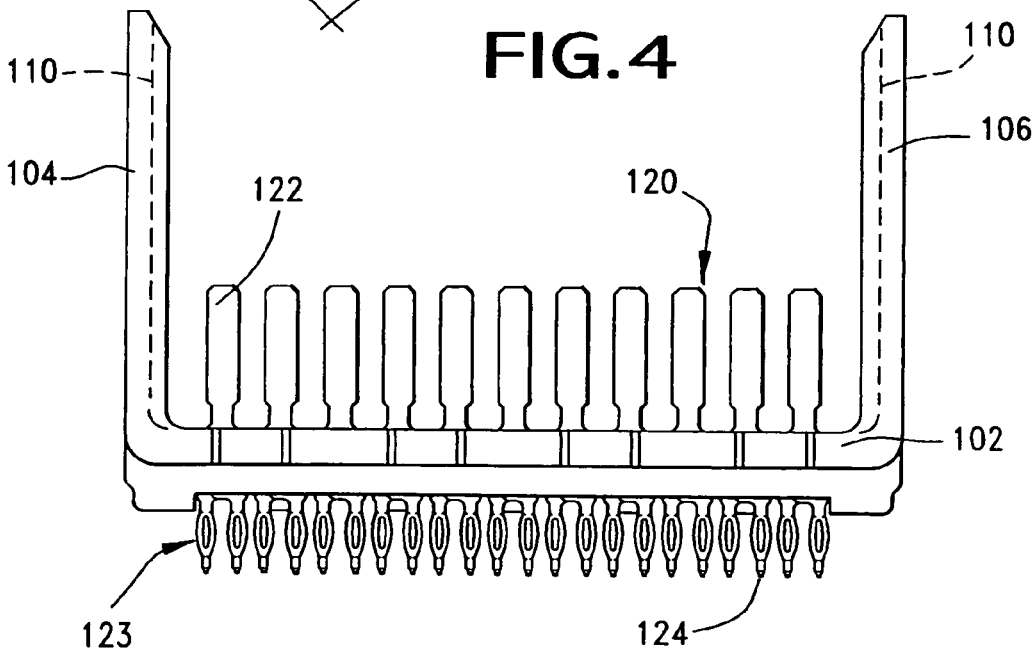
FIG. 4 is an end view of FIG. 3 taken along the line 4—4.

As shown in FIG. 4B, the header terminals 120 are formed in an offset manner so that their contact portions 121, which take the form of long, flat blades 122 extend in one plane P1, while thin tail portions 123, shown as compliant pin-style tails 124 extend in another plane P2, that is spaced apart from the first plane P1. The terminals 120 each include a body portion 126 that is received within a corresponding terminal-recovery cavity 111 that is formed in the base portion 102 of the backplane member 100. FIG. 4A illustrates the terminals 120 in one stage as they are stamped and formed along a carrier strip 127, and it can be seen that each terminal is interconnected together not only by the carrier strip 127, but also secondary pieces 128 that hold the terminals 120 in line during their forming process. These secondary pieces 128 are removed later in the forming process as the terminals 120 are removed, or singulated and then are inserted into the base 102 of the backplane member 100, such as by stitching.

Figure 5:
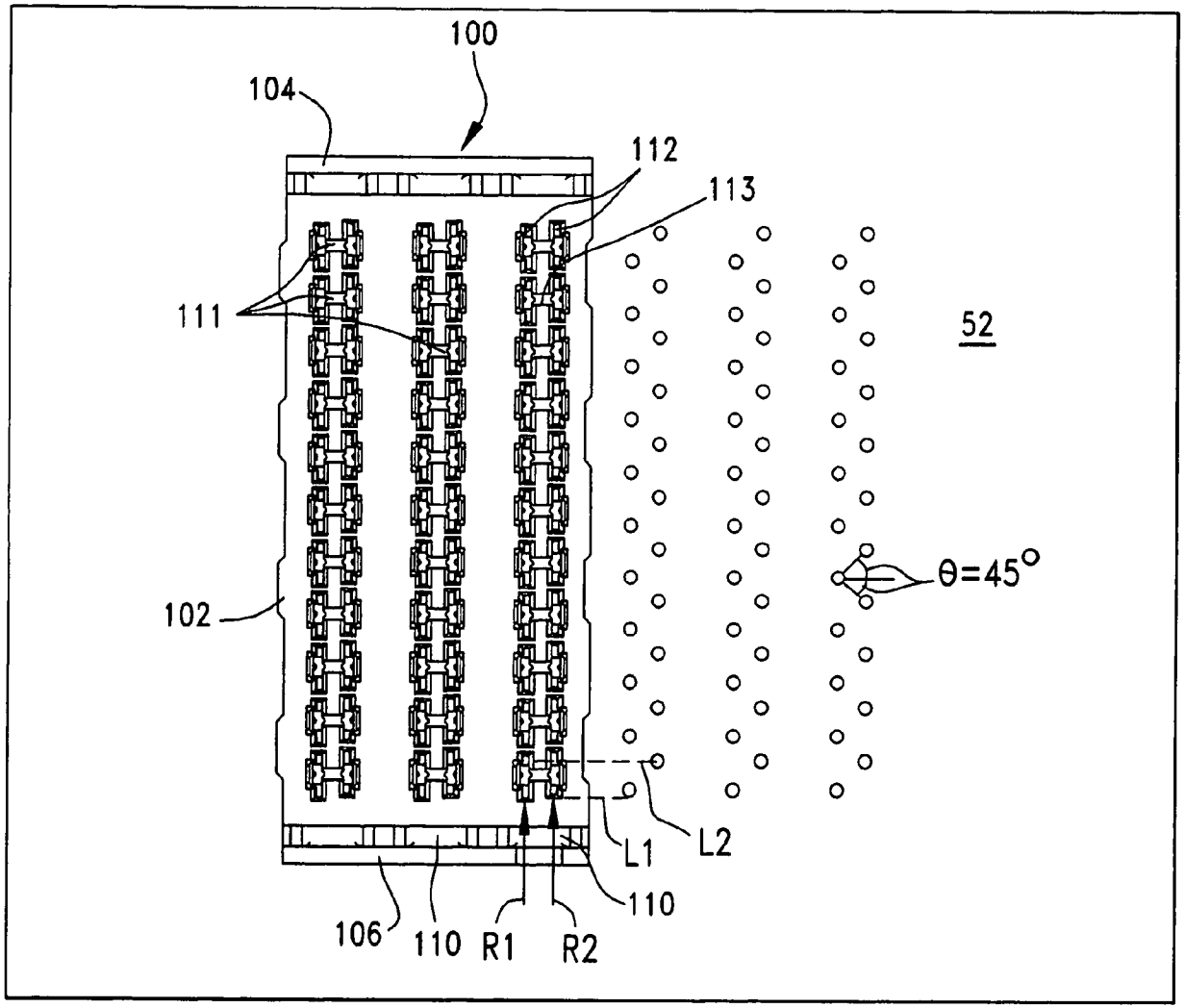
FIG. 5 is a top plan view of the backplane connector component in place on a circuit board and illustrating the tail via pattern used for such a component.

The contact blade portions 122 of the terminals 120 and their associated body portions 126 may include ribs 130 that are stamped therein and which preferably extend through the offset bends of the terminals 120. These ribs 130 serve to strengthen the terminals 120 by providing a cross-section to the terminals in this area which is better resistant to bending during insertion of the terminals 120 as well as mating with the terminals 206 of an opposing wafer connector component 202. Dimples 131 may also be formed in the terminal body portion 126 and in a manner such they project out to one side of each terminal 120 (FIG. 4B) and form a projection that will preferably interferingly contact one of the sidewalls of the terminal-receiving cavities 111 in the backplane member base portion 102. As illustrated in FIG. 5D, the backplane member base portion 102 may include a series of slots 132 formed which extend vertically and which will receive the terminal dimples 131 therein. The terminal-receiving cavities 111 are also preferably formed with interior shoulders, or ledges 134, which are best shown in FIG. 5D and which provide a surface against which the terminal body portions 126 rest.

As shown in FIG. 4A, the header terminals 120 preferably have their tail portions 123 offset as well. As shown, this offset occurs laterally of the terminals 120, so that the centerlines of the tail portions 123 are offset from the centerlines of the contact portions 121 by a distance P4. This offset permits, as clearly shown in FIG. 5, pairs of header terminal 120 to face each other and utilize the 45-degree orientation of vias shown in the right half of FIG. 5. As can be determined from FIG. 5, the compliant pin tail of one of the two rows R1 can use the bottom left via, while the compliant pin tail of the facing terminal can take the next via in the right row, and then with the pattern repeated for each pair, the vias of the header terminals, within each two rows are at 45 degree angles to each other, as shown diagrammatically to the right of FIG. 5. This facilitates the route out for such connectors on the circuit boards to which they are mounted.

As seen best in FIGS. 5A & 5C, the terminal-receiving cavities 111 of the backplane member 100 of the connectors of the invention are unique in that they are generally H-shaped, with each H-shape having two leg portions 112 that are interconnected by an arm portion 113. While the leg portions 112 of the H-shaped cavities 111 are filled with the body portions 126 of the terminals 120, the arm portions 113 of each cavity 111 remain open so that an air channel "AC" is defined in the arm portion 113 (FIG. 5A), the purpose of which will be explained in greater detail below. The spacing that results between the two terminal contact portions 122 is selected to match the approximate spacing between the two contact portions 216 of the wafer connector component terminals 206 that are received within the backplane member channels 110.

The H-shaped cavities 111 also preferably include angled edges 140, that define lead-in surfaces of the cavities 111 that facilitate the insertion of the terminals 120 therein, especially from the top side of the connector base 102. The cavities 111 include tail holes 114 that, s shown in FIG. 5A, are located at angled corners of each H-shaped opening 111.

The contact blade portions 122 of the terminals 120, are located above and slightly outboard of the leg portions 112 of the H-shaped cavities 111. This is due to the offset form present in their body portions 126, and this is best shown in a comparison between FIGS. 5A and 5B. FIG. 5B illustrates in an enlarged detail plan view, the backplane member base portion 102 without any terminals 120 present in the terminal-receiving cavities 111, while FIG. 5A illustrates, also in an enlarged top plan view, the terminal-receiving cavities 111 being filled with the terminals 120. In FIG. 5A, one can see that the contact blade portions extend outwardly into the areas between the rows of terminals so that the outer surfaces 124 thereof are offset from the outermost inner edges 141 of the base member terminal-receiving cavities 111.

Figure 6:
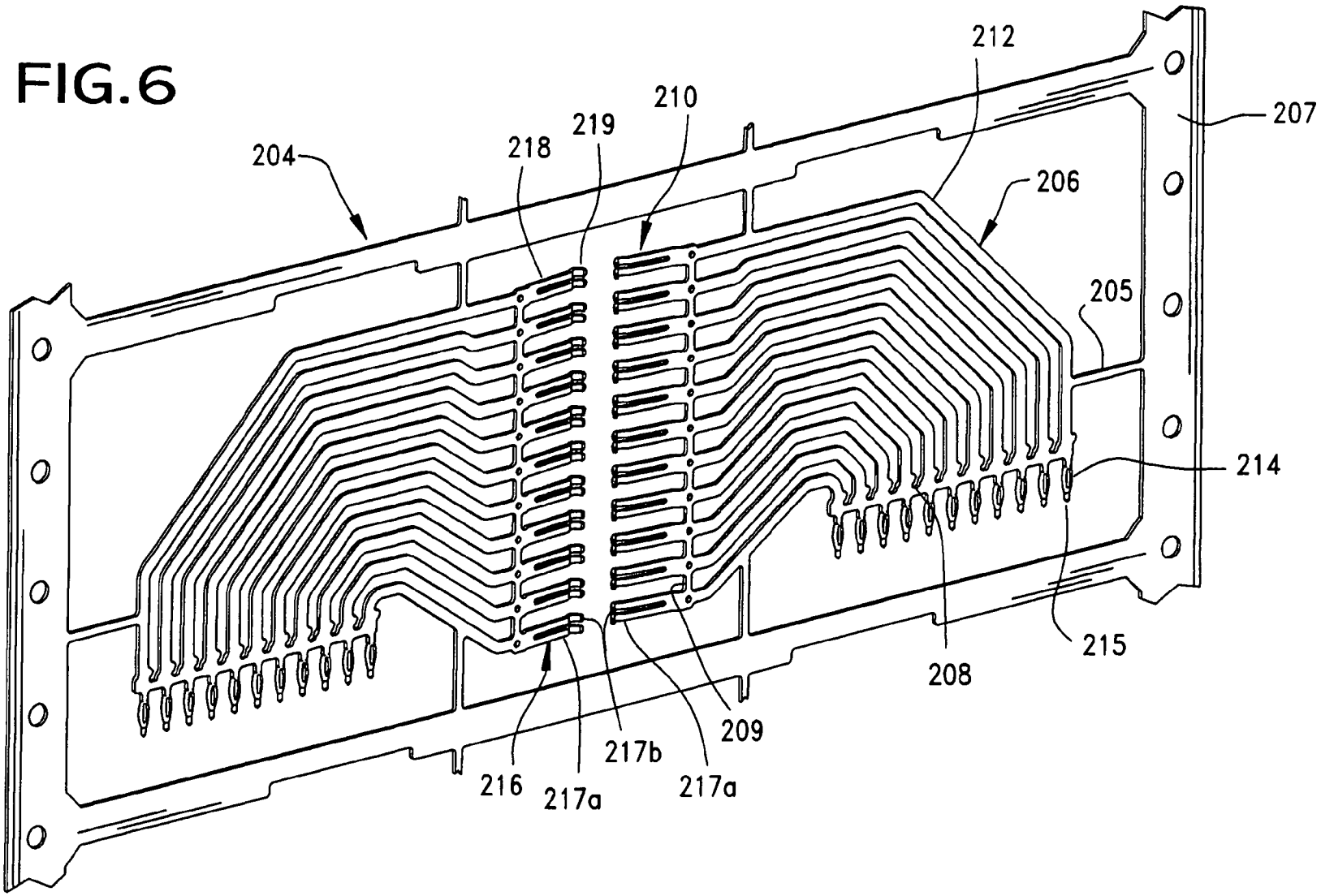
FIG. 6 is a perspective view of a stamped lead frame illustrating the two arrays of terminals that will be housed in a single wafer connector component.

FIG. 6 illustrates a metal lead frame 204 which supports a plurality of conductive terminals 206 that have been stamped and formed in preparation for subsequent molding and singulation. The lead frame 204 shown supports two sets of terminals 206, each set of which is incorporated into an insulative support half 220*a*, 220*b*, which are subsequently combined to form a single wafer connector component 202. The terminals 206 are formed as part of the lead frame 204 and are held in place within an outer carrier strip 207 and the terminals are supported as a set within the lead frame 204 by first support pieces, shown as bars 205, that interconnect the terminals to the lead frame 204 and also by second support pieces 208 that interconnect the terminals together. These support pieces are removed, or singulated, from the terminal sets during assembly of the wafer connector compnents 202.

Figure 7:
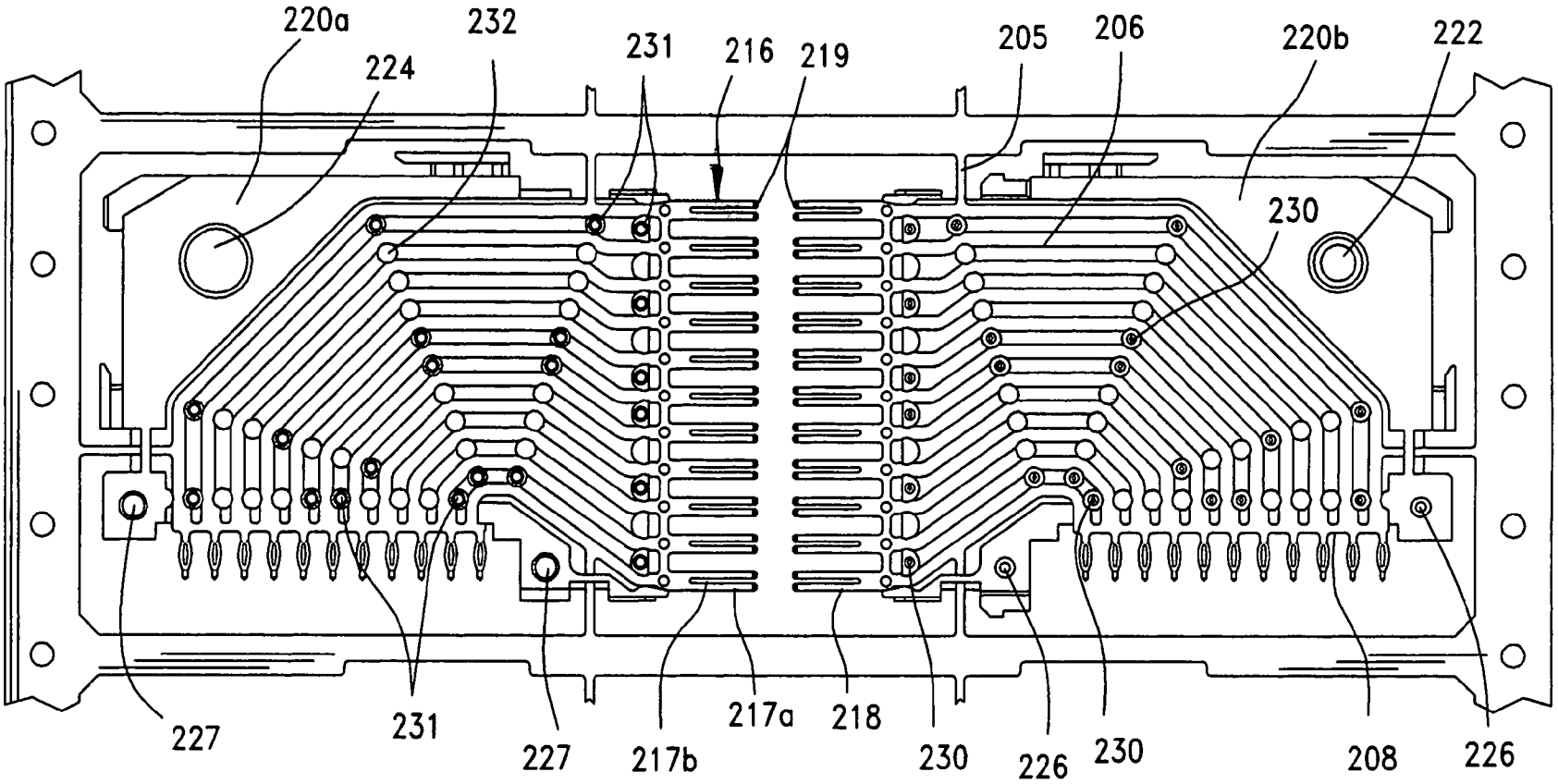
FIG. 7 is an elevational view of the lead frame of FIG. 6, taken from the opposite side thereof and showing the wafer halves formed over the terminals.

FIG. 7 illustrates the lead frame 204 with the support, or wafer halves 220*a*, 220*b* molded over portions of the set of eleven individual terminals 206. In this stage, the terminals 206 are still maintained in a spacing within the support halves by the support halve material and by the second interconnecting pieces 208, 209 that are later removed so that each terminal stands 206 by itself within the completed wafer connector component 202 and is not connected to any other terminal. These pieces 208, 209 are arranged outside of the edges of the body portions of the wafer connector component halves 220*a*, 220*b*. The support halves 220*a*, 220*b* are symmetric and are aptly described as mirror images of each other.

Figure 7A:
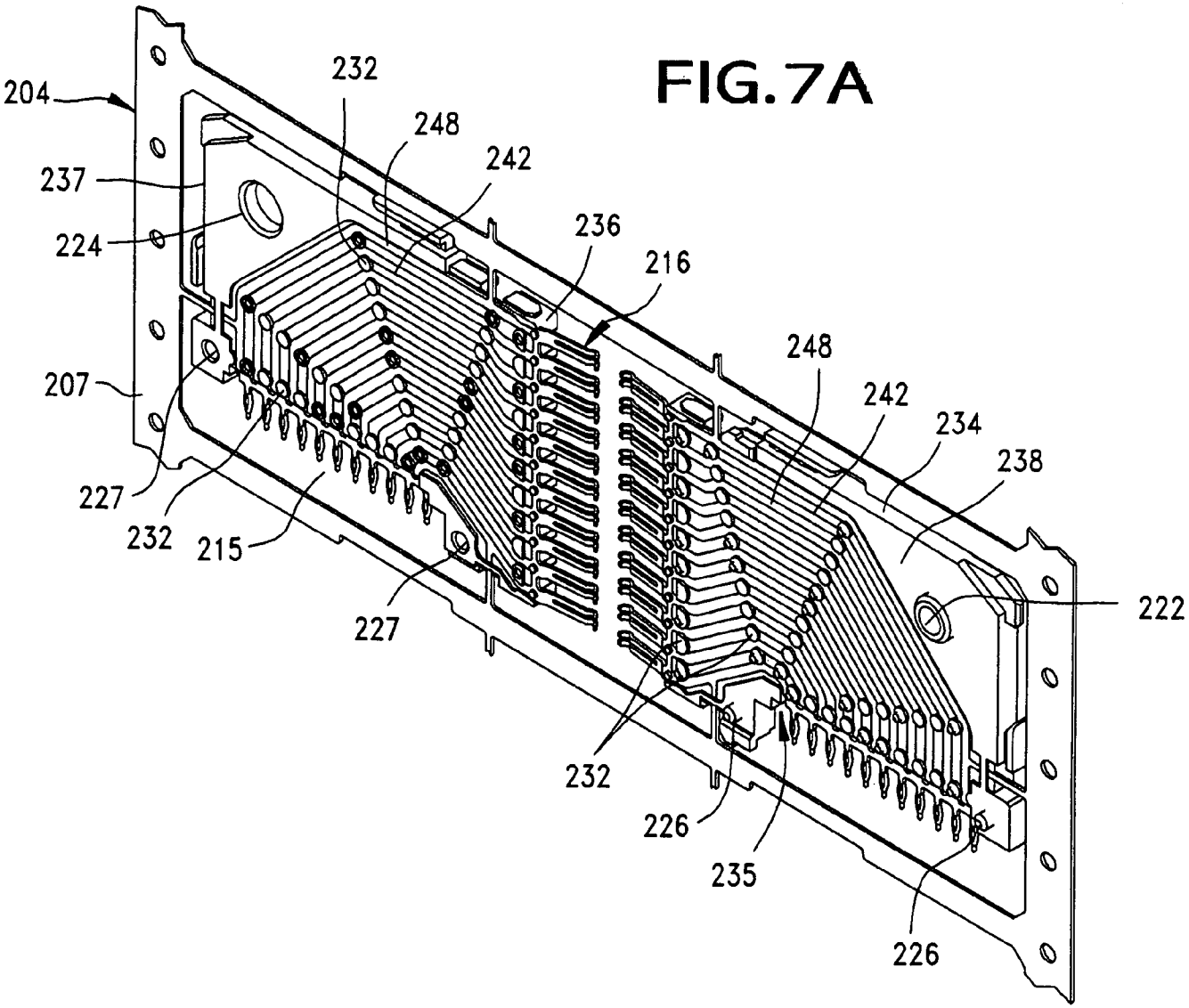
FIG. 7A is the same view of FIG. 7, but in a perspective view.

FIG. 7A illustrates best the structure which is used to connect the two wafer halves 220*a*, 220*b* together, which are shown as complimentary relatively large-shaped posts 222 and openings, or holes 224. One large post 222 and large opening 224 are shown in FIG. 7A and they are positioned within the body portion 238 of the connector component halves 220*a*, 220*b*. Three such posts 220 & 226 are shown as formed in the body portions of the wafer connector halves 220*a*, 220*b* and the other posts 230, as shown, are much smaller in size, and are positioned between selected terminals and are shown extending out of the plane of the body portion 220*b*. These posts 230 extend from what may be considered as standoff portions 232 that are formed during the insert molding process, and the standoff portions 232 serve to assist in the spacing between terminals within each wafer half and also serve to space the terminals apart in their respective rows when the halves are assembled together.

Figure 14:
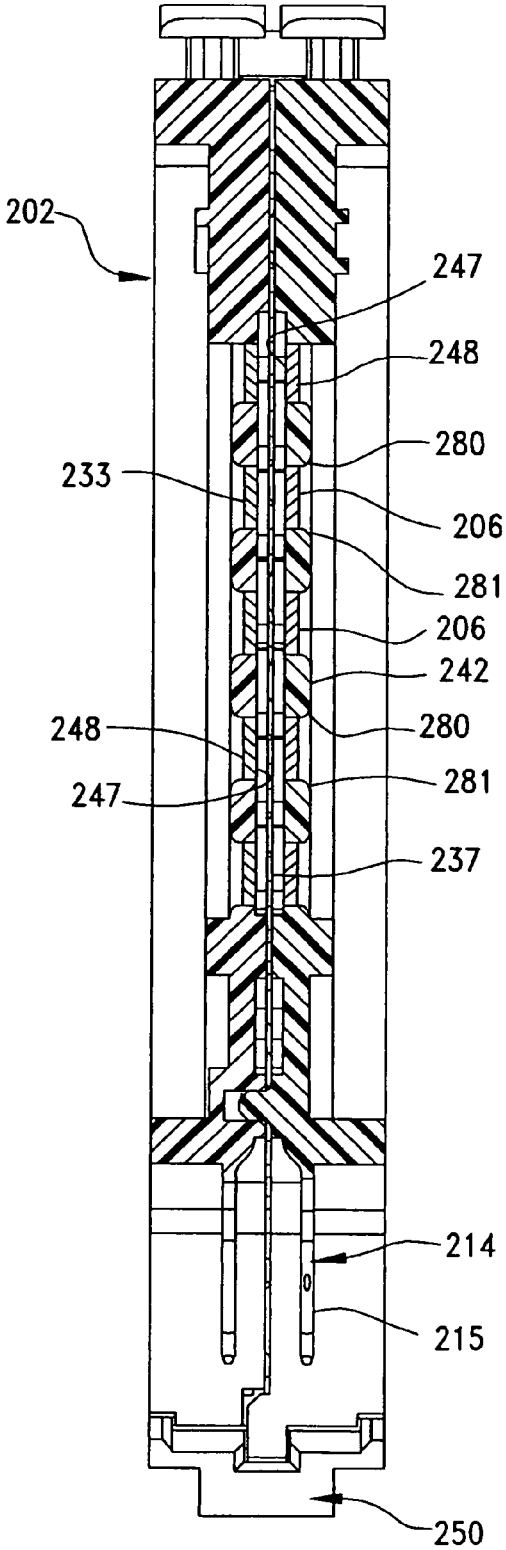
FIG. 14 is a sectional view of the wafer connector component of FIG. 11, taken along vertical line 14—14 thereof.
Figure 15:
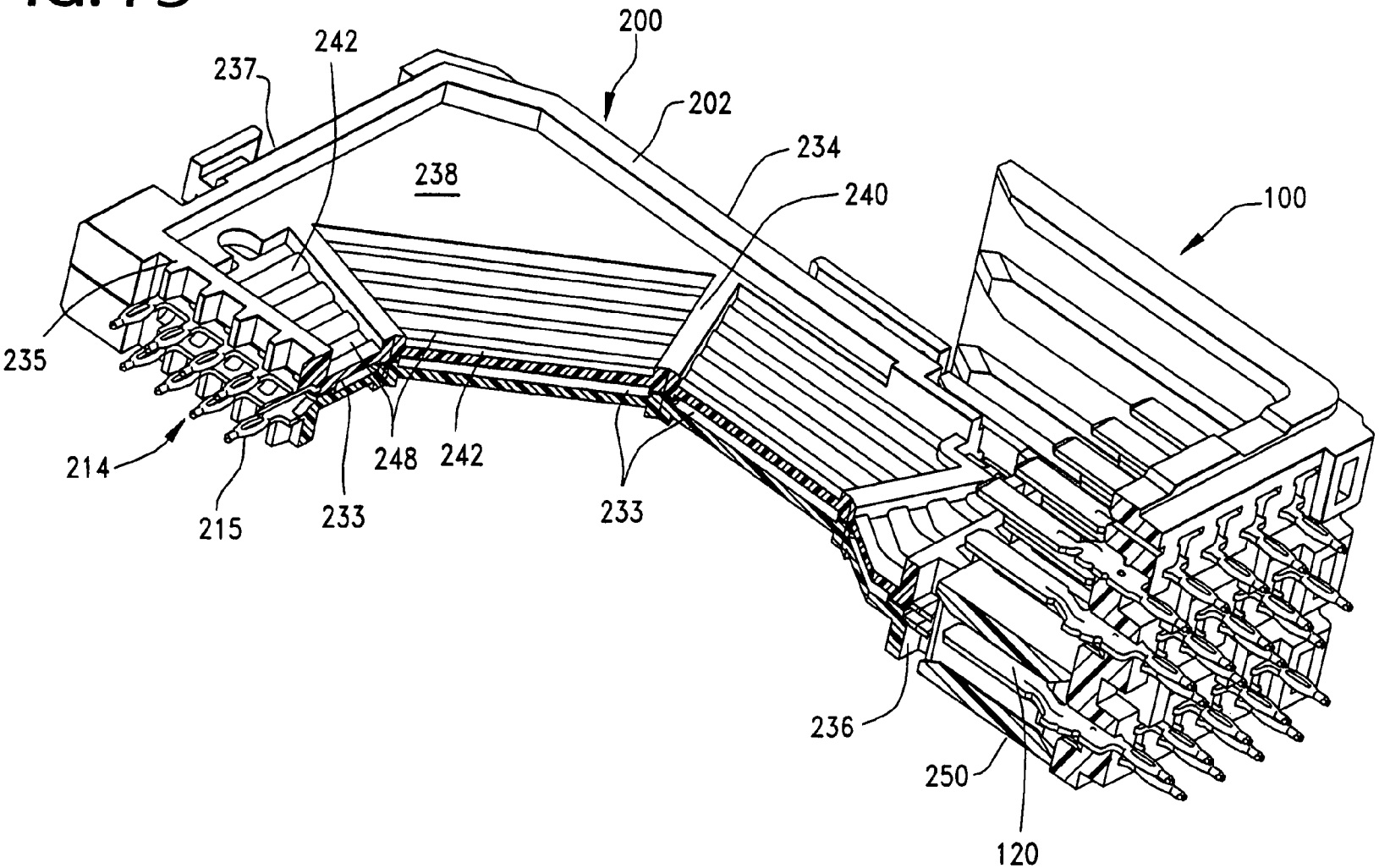
FIG. 15 is a perspective view, partly in section of a wafer connector component and backplane member mated together.
Figure 17:
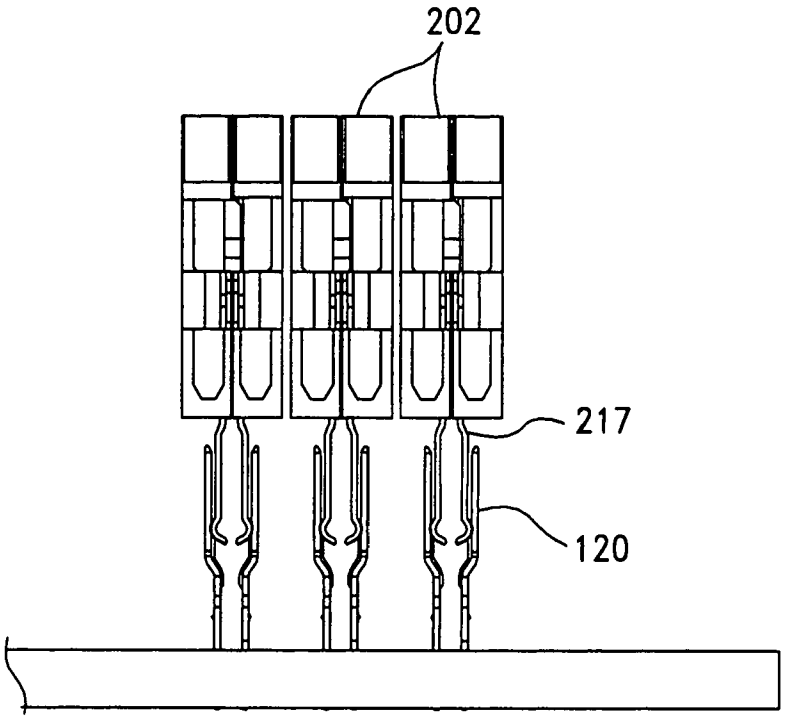
FIG. 17 is a similar view to FIG. 16, but with the wafer connector component terminals being supported by their respective connector component supports.
Figure 16:
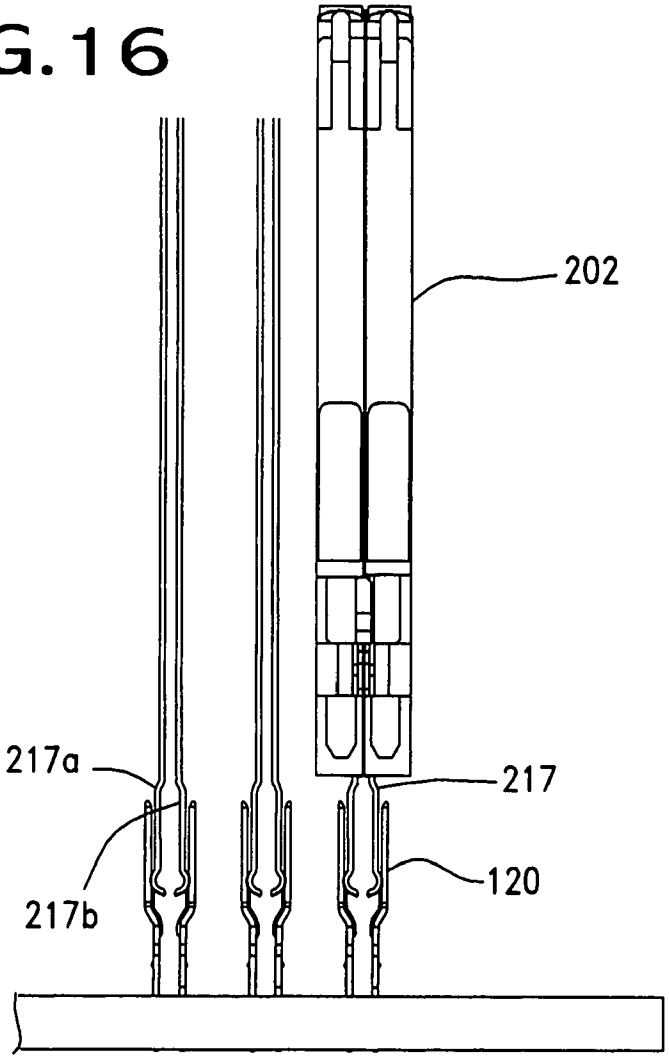
FIG. 16 is an end diagrammatic view of the wafer connector component and backplane member mated together with the cover member removed for clarity to illustrate the manner of mating with connectors of the present invention.

These smaller posts are respectively received within corresponding openings 231, which similar, to the posts 230, are preferably formed as part of selected ones of the standoff portions 232. In an important aspect of the present invention, no housing material is provided to cover the inner faces of the terminal sets so that when the wafer connector components are assembled together, the inner vertical sides, or surfaces 247 of each pair of terminals 206 are exposed to each other. The posts and openings 230, 231 and the standoff portions 232 are cooperate in defining an internal cavity within each wafer connector component 202, and this cavity 237 is best seen in the sectional views of FIGS. 12 & 14.

Figure 8:
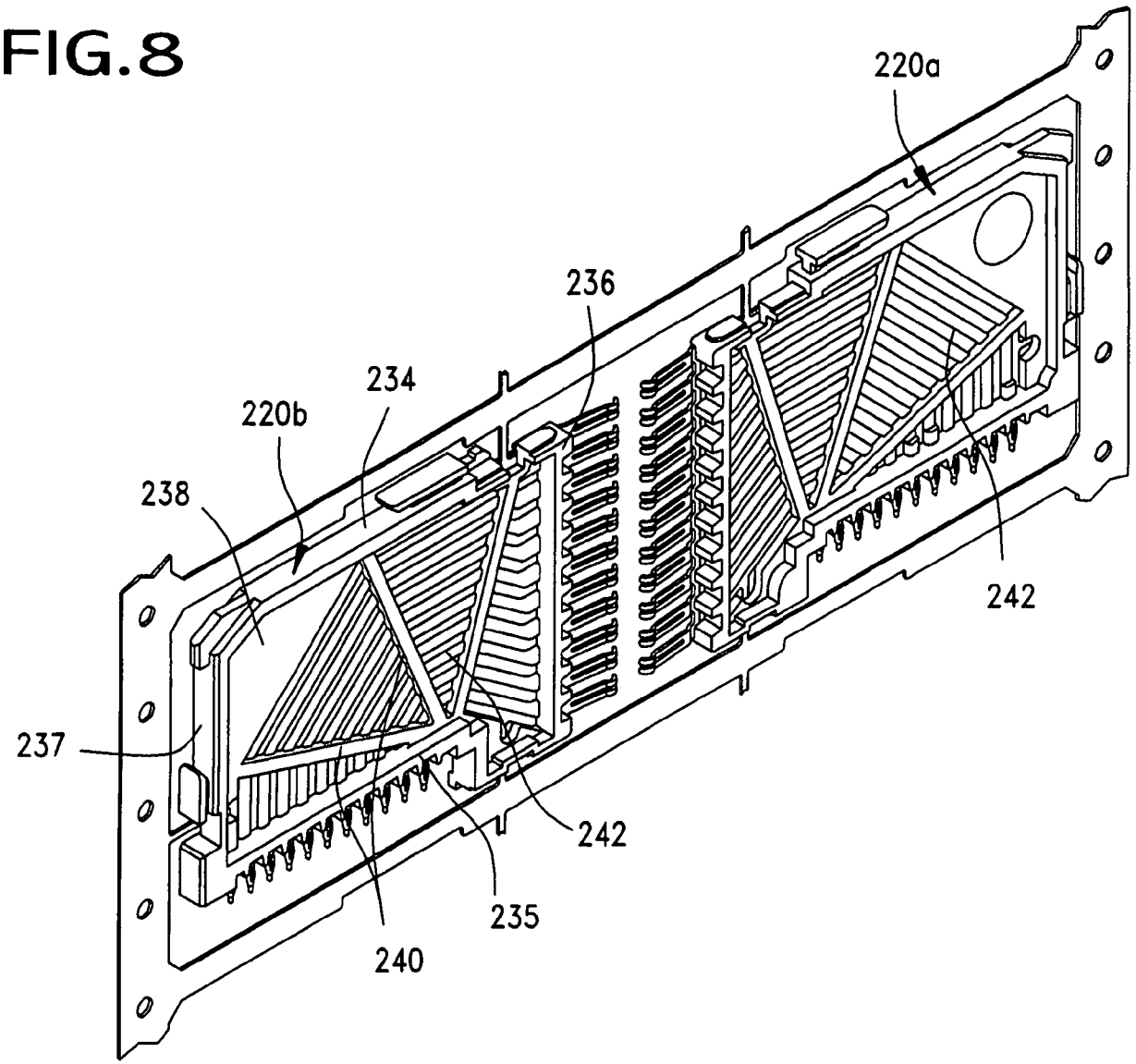
FIG. 8 is a perspective view of FIG. 7 but taken from the opposite side thereof.

FIG. 8 shows the opposite, or outer sides, of the wafer connector components and it can be seen that the wafer connector components halves 220*a*, 220*b* form what may be aptly described as a skeletal framework that utilizes structure in the form of cross braces 240 and interstitial filler pieces, or ribs 242, that extend between adjacent terminals in the vertical direction, and which preferably contact only the top and bottom edges of adjacent terminals. In this manner, the exterior surfaces 248 of the terminals (FIG. 9) are also exposed to air, as are the inner surfaces 247 of the terminals 206. These filler ribs 242 are typically formed from the same material from which the wafer connector component body portions 238 are made and this material is a preferably a dielectric material. The use of a dielectric material will deter significant capacitive coupling from occurring between the top and bottom edges 280, 281 of the terminals (FIG. 14), while driving the coupling that does occur, to occur in a broadside manner between pairs of terminals arranged horizontally.

Figure 9:
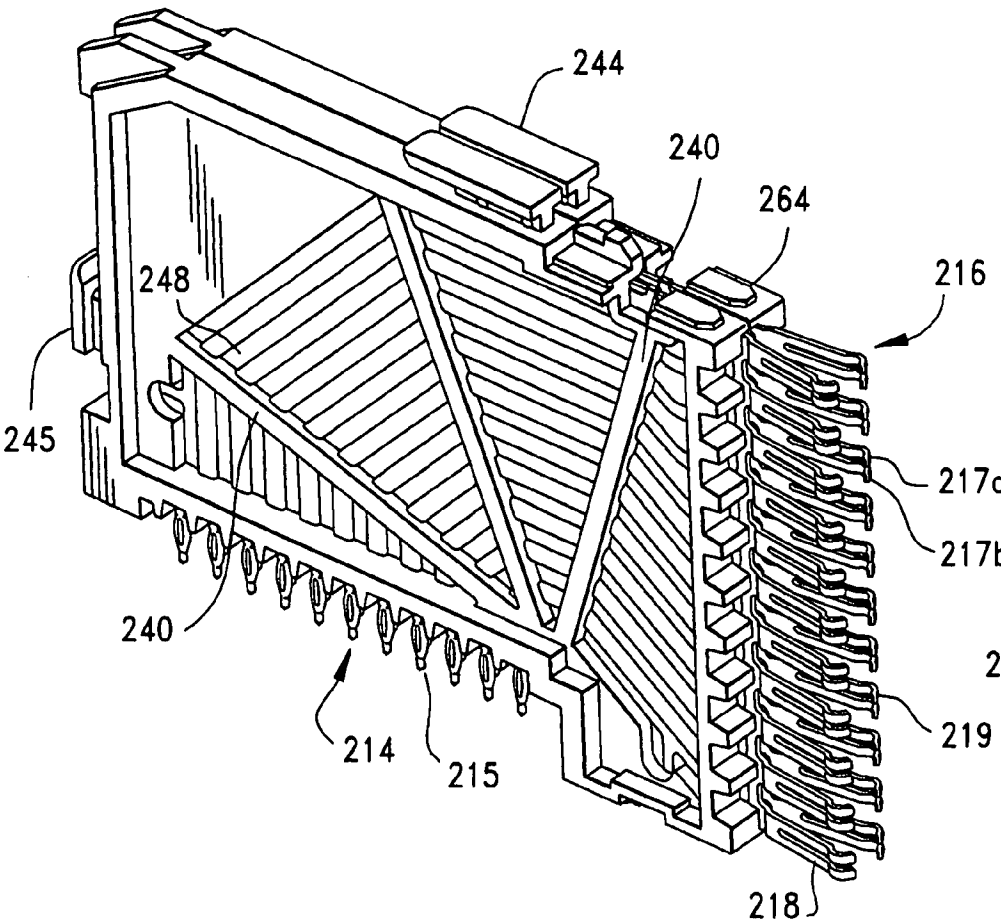
FIG. 9 is a perspective view of the two wafer halves of FIG. 8, assembled together to form a single wafer connector.
Figure 18B:
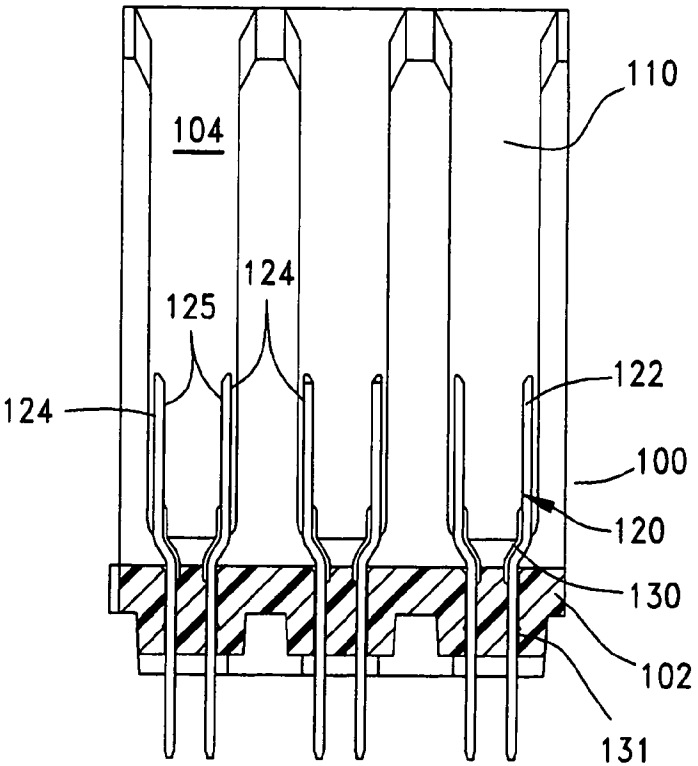
FIG. 18B is the same view as FIG. 18A, but with the wafer connector component removed from clarity.
Figure 18A:
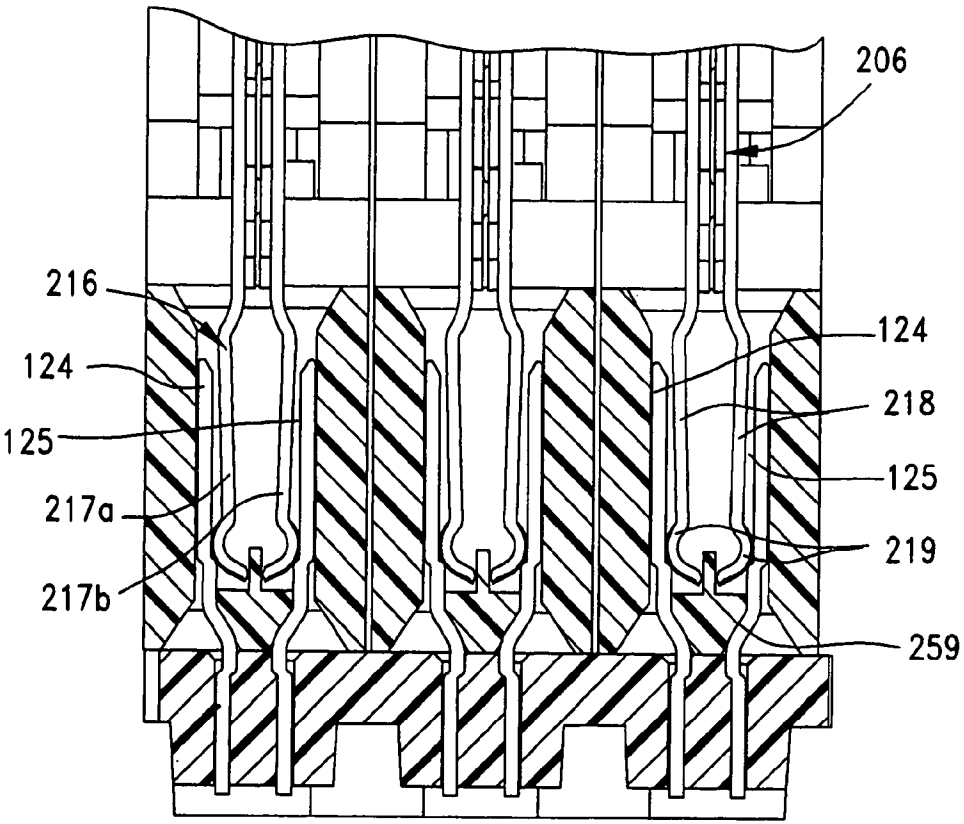
FIG. 18A is an enlarged sectional detail view of the mating interface between the wafer connector component and the backplane member, and showing the component and member.

FIG. 9 illustrates a completed wafer connector component that has been assembled from two halves. The terminals of this wafer connector component have contact and tail portions arranged along two edges and in the embodiment shown, the edges may be considered as intersecting or perpendicular to each other. It will be understood that the edges could be parallel or spaced apart from each other as might be used in an interposer-style application. The first set of contact portions 216 are the dual beam contact portions 217*a*, 217*b* that are received in the central portion of the backplane member 100 of the assembly, while the second set of contact portions 214 serve as tail portions and as such, utilize compliant pin structures 215 so that they may be removably inserted into openings, or vias, of circuit boards. The contact portions 216 of the wafer connector component 202 are formed as dual beams 217 and they extend forwardly of a body portion of each terminal. The ends of the terminal contact portions 216 are formed into curved contact ends 219 that are at the ends of the bodies 218 of the contact beams. These curved ends 219 face outwardly so that they will ride upon and contact the flat blade contacts 122 of the backplane member terminals 120. (FIG. 18A.)

Figure 19:
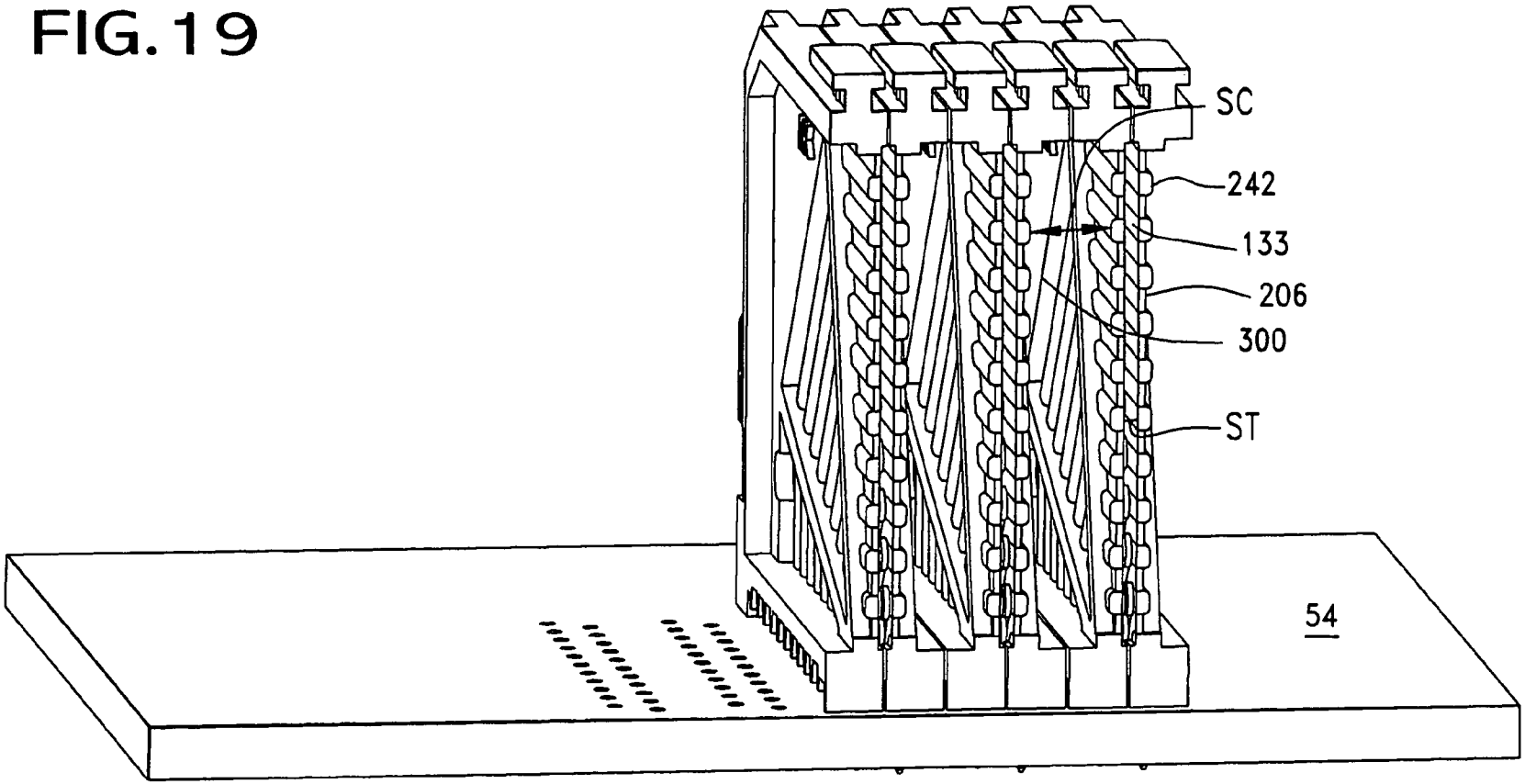
FIG. 19 is an angled end sectional view of three wafer connector components in place upon a circuit board, illustrating the air gaps between adjacent signal pairs and the air gap between adjacent wafer connector components.
Figure 20:
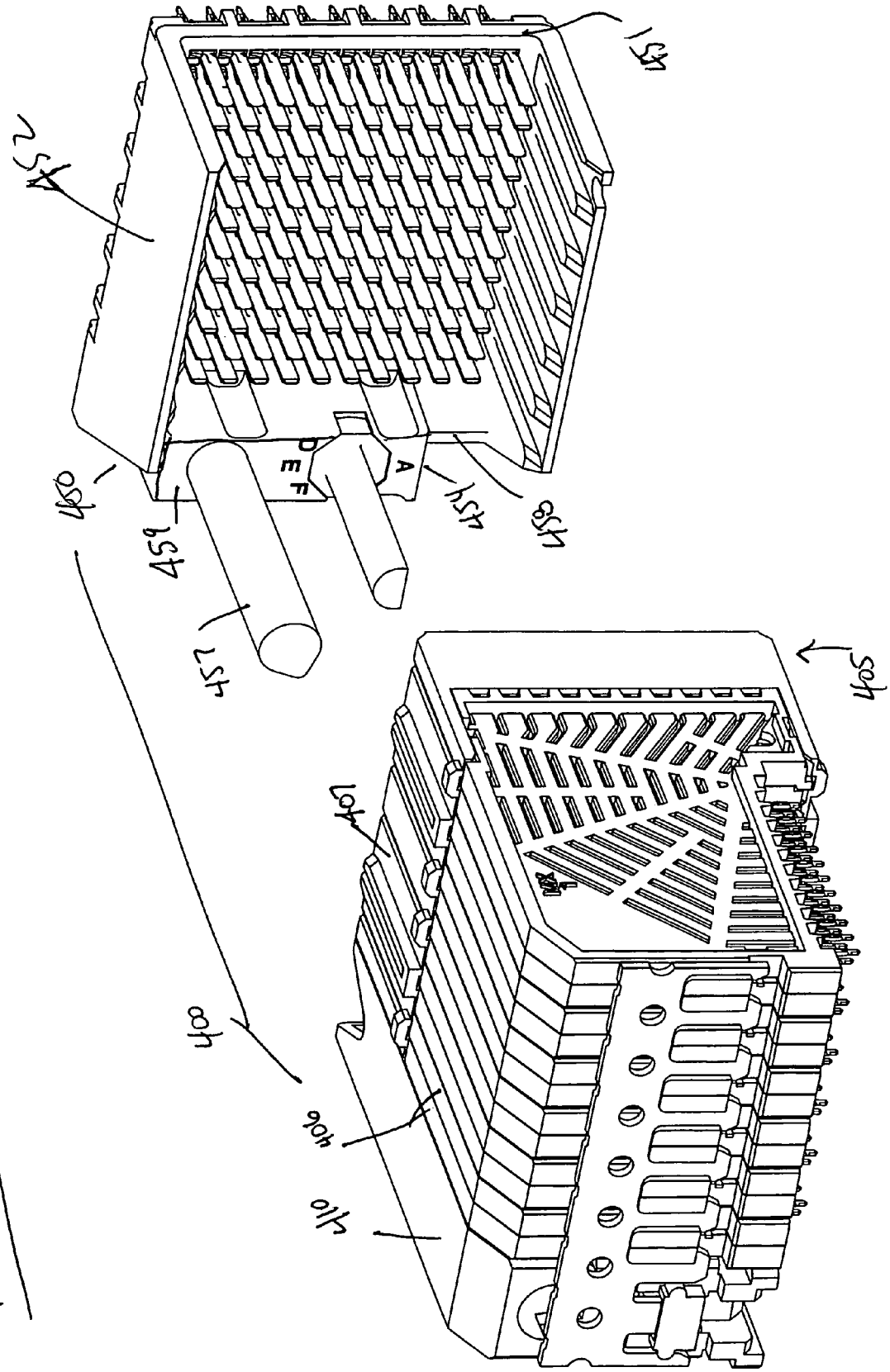
FIG. 20 is a perspective view of a connector element assembly and a pin header of the present invention with guide means integrated therewith.

When assembled together as a unit of wafers, there is present not only the air channel 133 between the terminals 206 within each wafer connector component 202, but also an air spacing 300 between adjacent wafer connector components, as shown in FIG. 19. The terminals are preferably spaced apart a first preselected distance ST uniformly through out the connector assembly, which defines the dimension of the air channel. This spacing is between designated pairs of terminals in each of the connector elements and this spacing is the same on an edge-to-edge basis within each connector element. Preferably, the spacing SC between connector elements, is greater than the spacing ST. (FIGS. 19 & 20.) This spacing helps create isolation between wafer connector elements.

Figure 10:
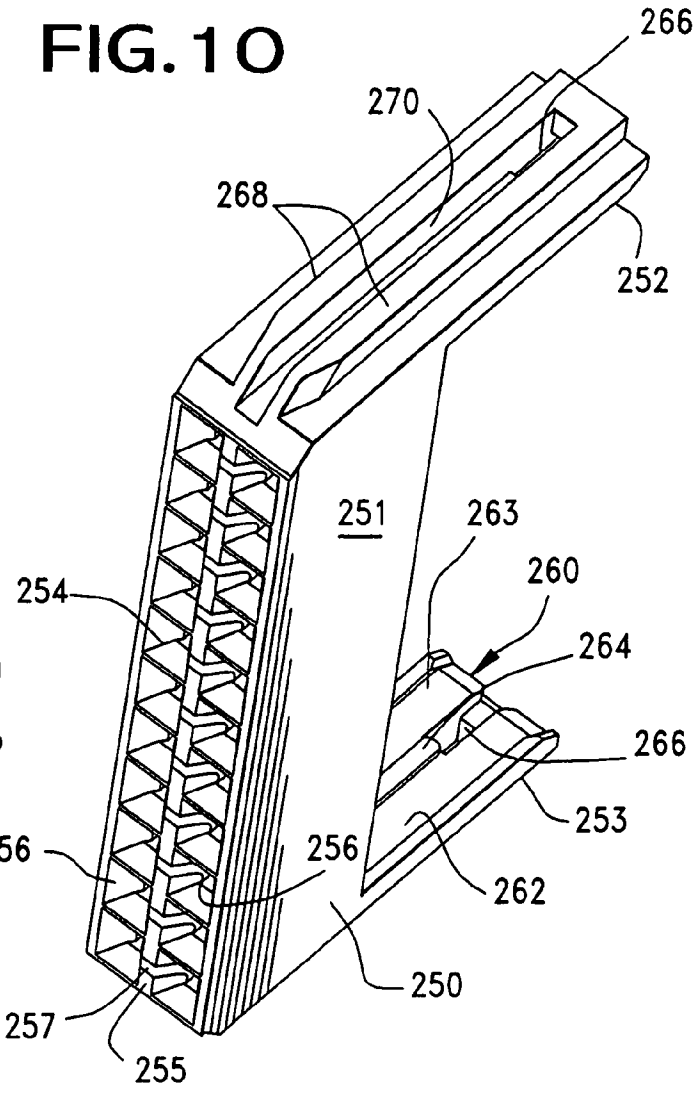
FIG. 10 is a perspective view of a cover member used with the wafer connector of FIG. 9.
Figure 11:
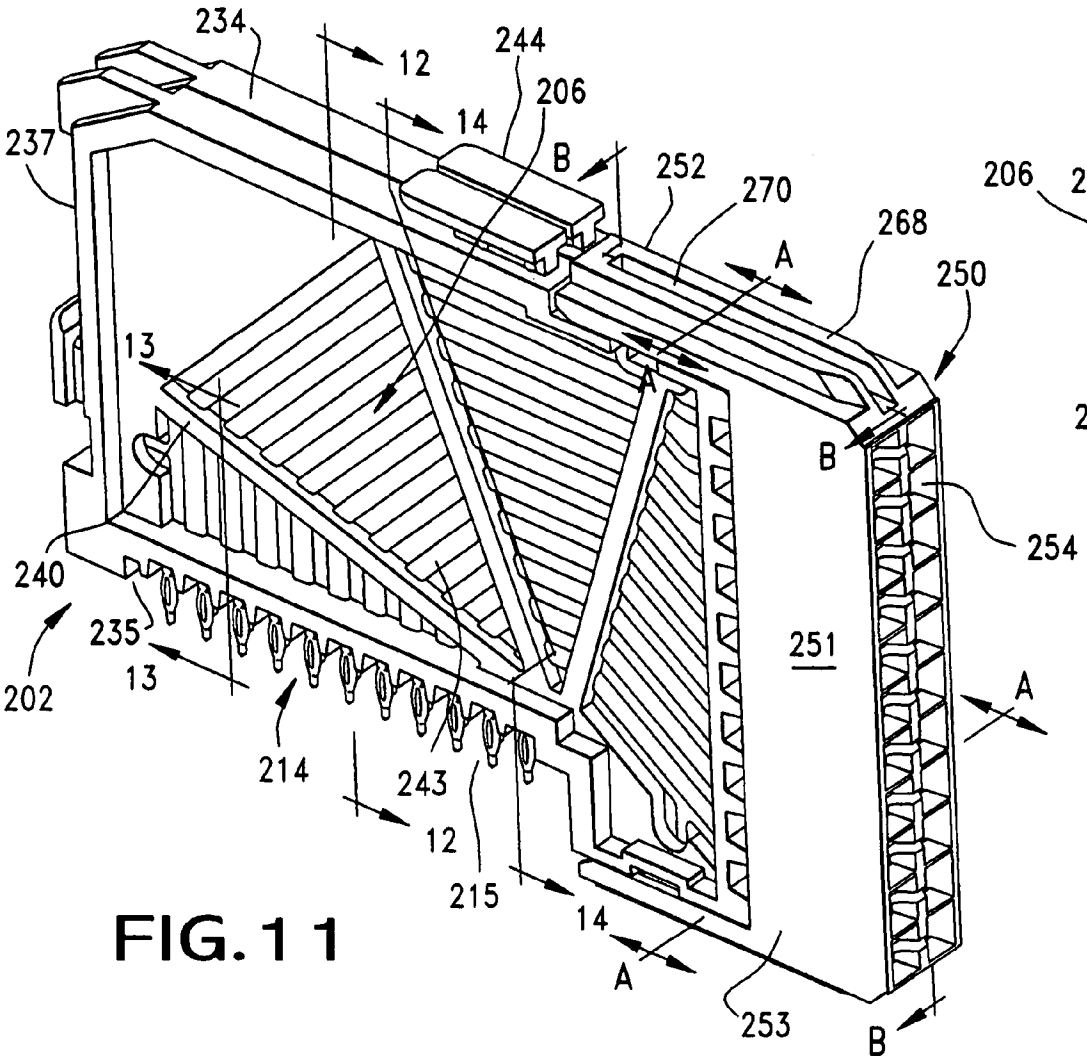
FIG. 11 is the same view as FIG. 9, but with the cover member in place to form a completed wafer connector component.
Figure 11A:
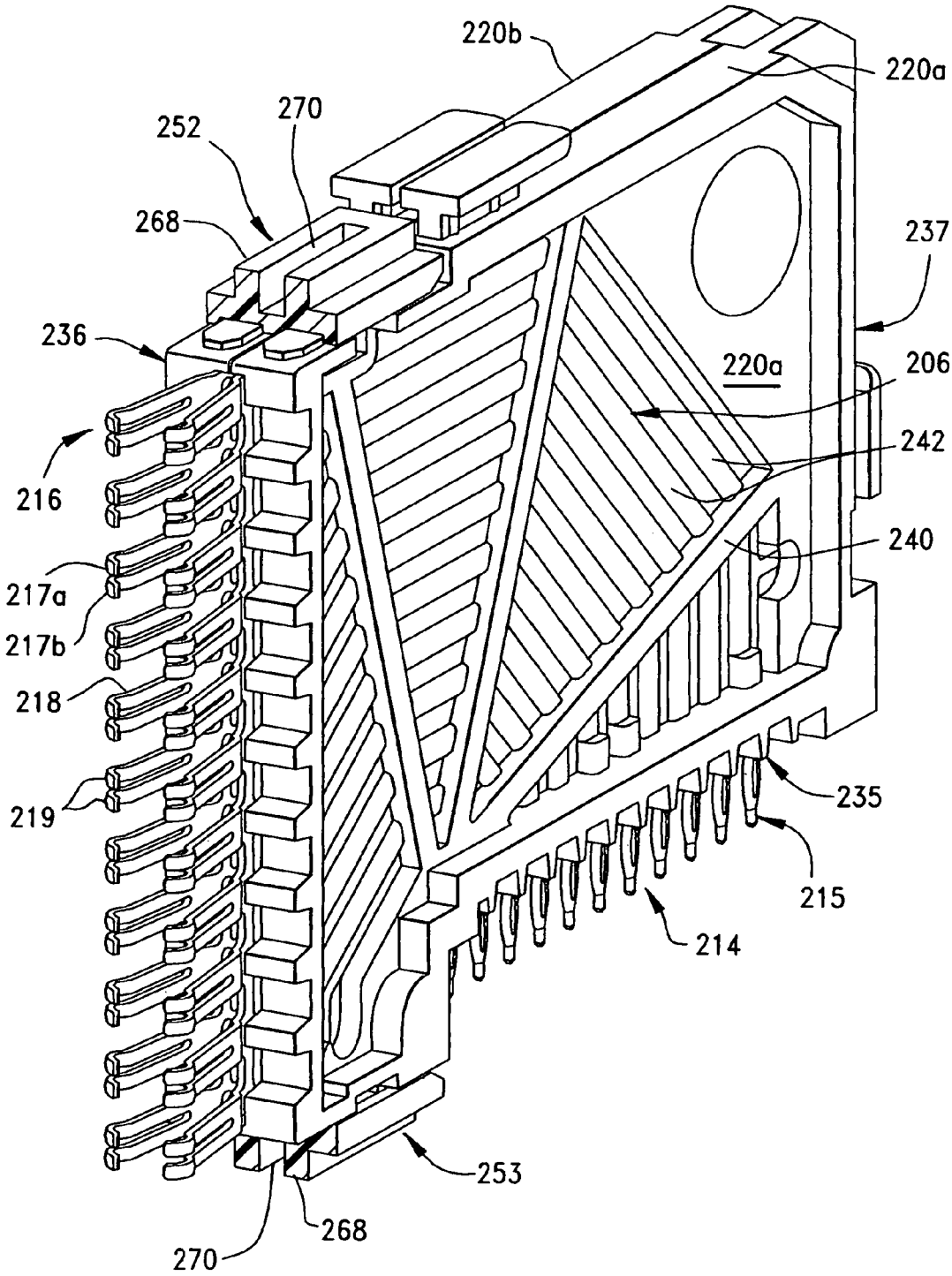
FIG. 11A is a sectional view of the wafer connector component FIG. 11, taken from the opposite side and along lines A—A of FIG. 11, with a portion of the cover member removed for clarity.

A cover member 250 is utilized to protect the dual beam contacts 217*a*, 217*b* and such a cover member 250 is shown in FIGS. 10 through 11 as one of a construction that covers the front end of only a single wafer connector element. The cover member 250 is shown in place upon the wafer connector component 202 in FIG. 11, and it serves as a protective shroud for the dual beam contacts 217*a*, 217*b*. The cover member 250 is preferably molded from an insulative material, such as a plastic that also may be chosen for a specific dielectric property. The cover member 250 has an elongated body portion 251 that extends vertically when applied to the wafer connector component 202 and the body portion 251 includes spaced-apart top and bottom engagement arms 252, 253. In this manner, the cover member 250 has a general U-shape when viewed from the side, and as illustrated in FIG. 10, it generally fits over the contact portions 216 of the terminals 206 of the wafer connector components 202, while the arms 252, 253 engage the wafer connector component 202 and serve to hold it in place.

Figure 10A:
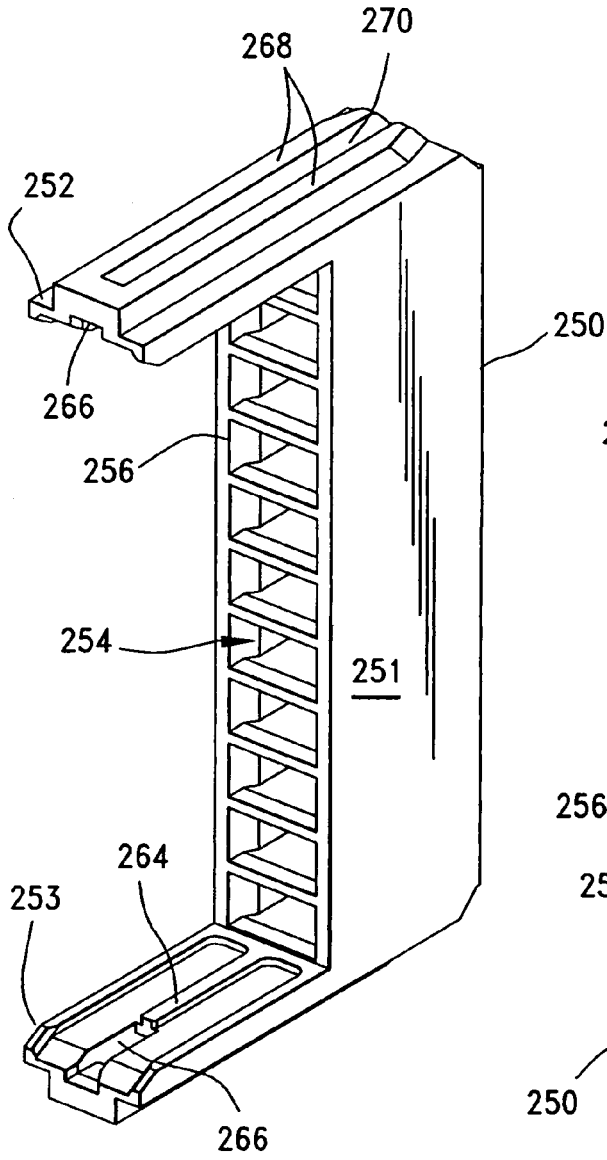
FIG. 10A is the same view as FIG. 9, but taken from the opposite side and illustrating the interior of the cover member.
Figure 10B:
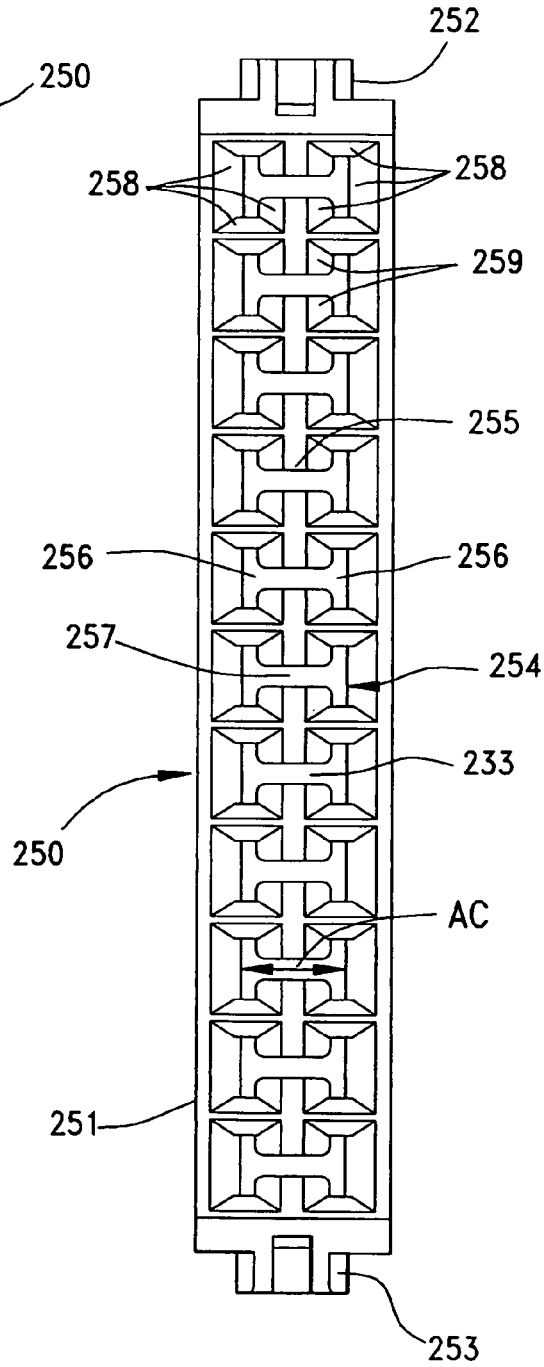
FIG. 10B is a front elevational view of the cover member of FIG. 10, illustrating the I-shaped channels of the mating face thereof.
Figure 10C:
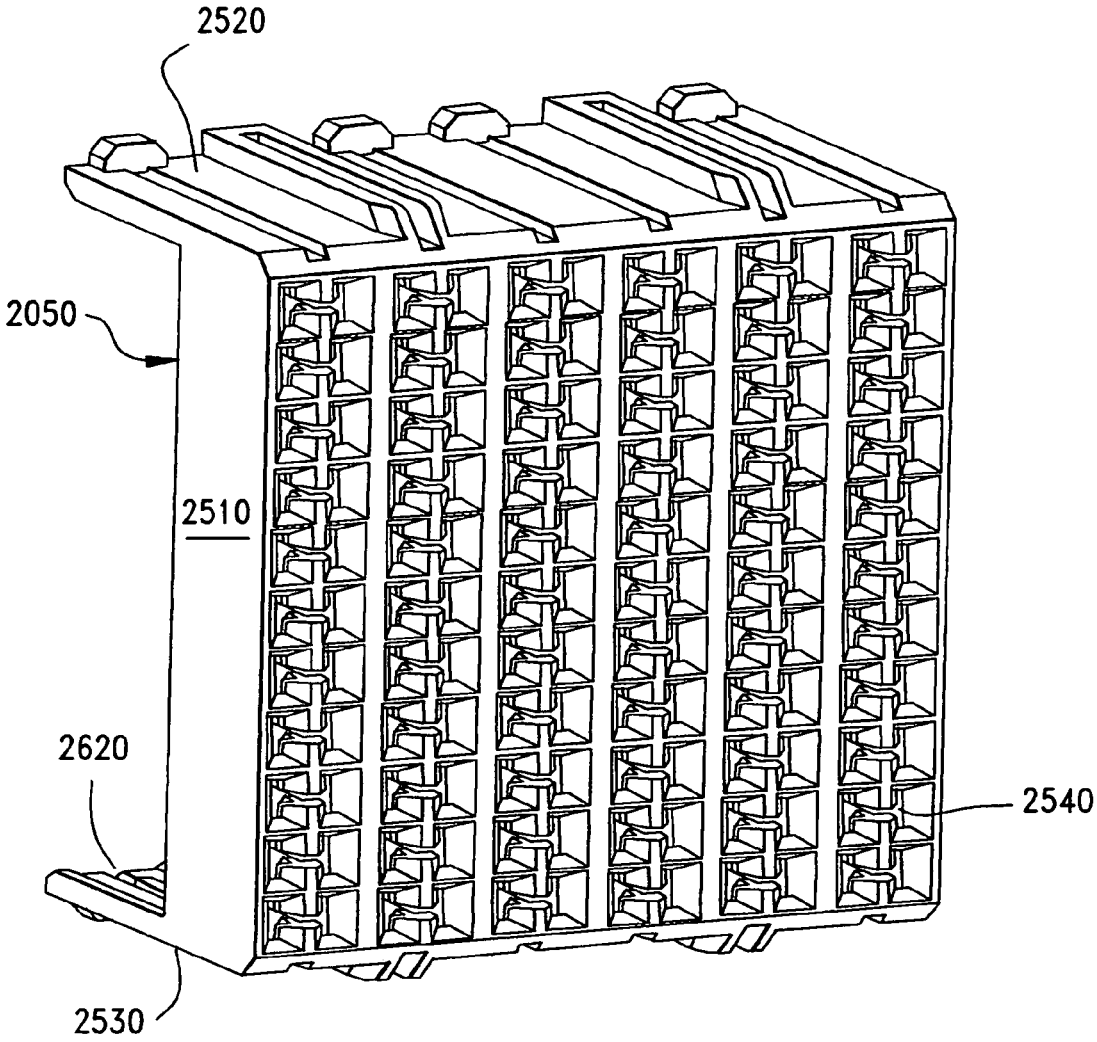
FIG. 10C is a frontal perspective view of the cover member that receives therein, the front ends of a plurality of connector elements of the style illustrated in FIG. 9.

The cover member 250 is formed with a plurality of cavities, or openings 254, and these are shown best in FIGS. 10 and 10B. The cavities 254 are aligned which each other in side-by-side order so that they accommodate a horizontal pair of terminal contact portions 216 of the wafer connector component 202. The cover member 250 may also include various angled surfaces 258 that serve as lead ins for the terminals 120 of the backplane member 100. As shown best in FIG. 10B, each such cavity 254 has a general H-shape, with the dual beam contacts 216 being received in the leg portions 256 of the H-shape. The leg portion openings 256 are interconnected together by intervening arm portions 257 of the H-shape, and these arm portions 257 are free of any terminal or wafer material so that each one acts as an air channel AC that extends between opposing surfaces of the dual beam contacts 217. As is the case with the backplane member H-shaped cavities 111, the cavities 254 of the cover member 250 also permit broadside coupling between the terminal contact portions 216 of the wafer connector component. FIG. 10C illustrates a cover member 2050 that is wider than just a single connector wafer element as in FIGS. 10–10B. This cover member 2050 includes internal channels 2620 formed in the interior surfaces of the end walls 2520, 2530 which extend between the side walls 2510 thereof. The cover member 2050 includes the H-shaped openings 2540 and angled lead-in surfaces in the same fashion as those shown and described for the cover member 250 to follow.

Figure 12:
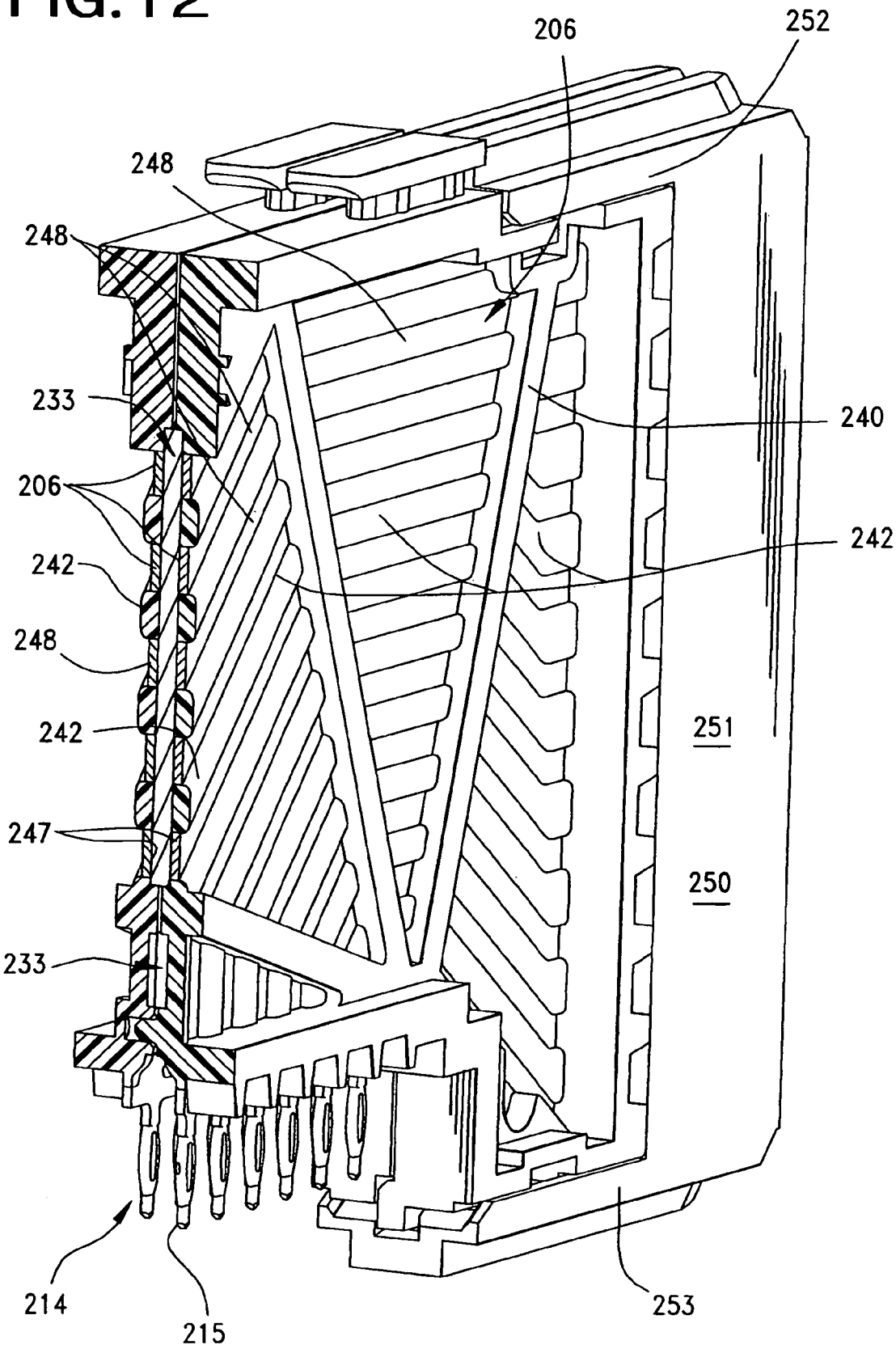
FIG. 12 is a sectional view of the wafer connector component of FIG. 11, taken along the vertical line 12—12 thereof.

In this manner, the air channel AC that is present between horizontal pair of terminals 206 (and which is shown in FIG. 12) of the wafer connector component 202 is maintained through the entire mating interface from the connector element tail portions mounted to the circuit board, through the wafer connector component, and into and through the backplane or header connector. It will be appreciated that the air channels 257 of the cover member cavities 254 are preferably aligned with the air channels 113 of the backplane member cavities 111.

Figure 11B:
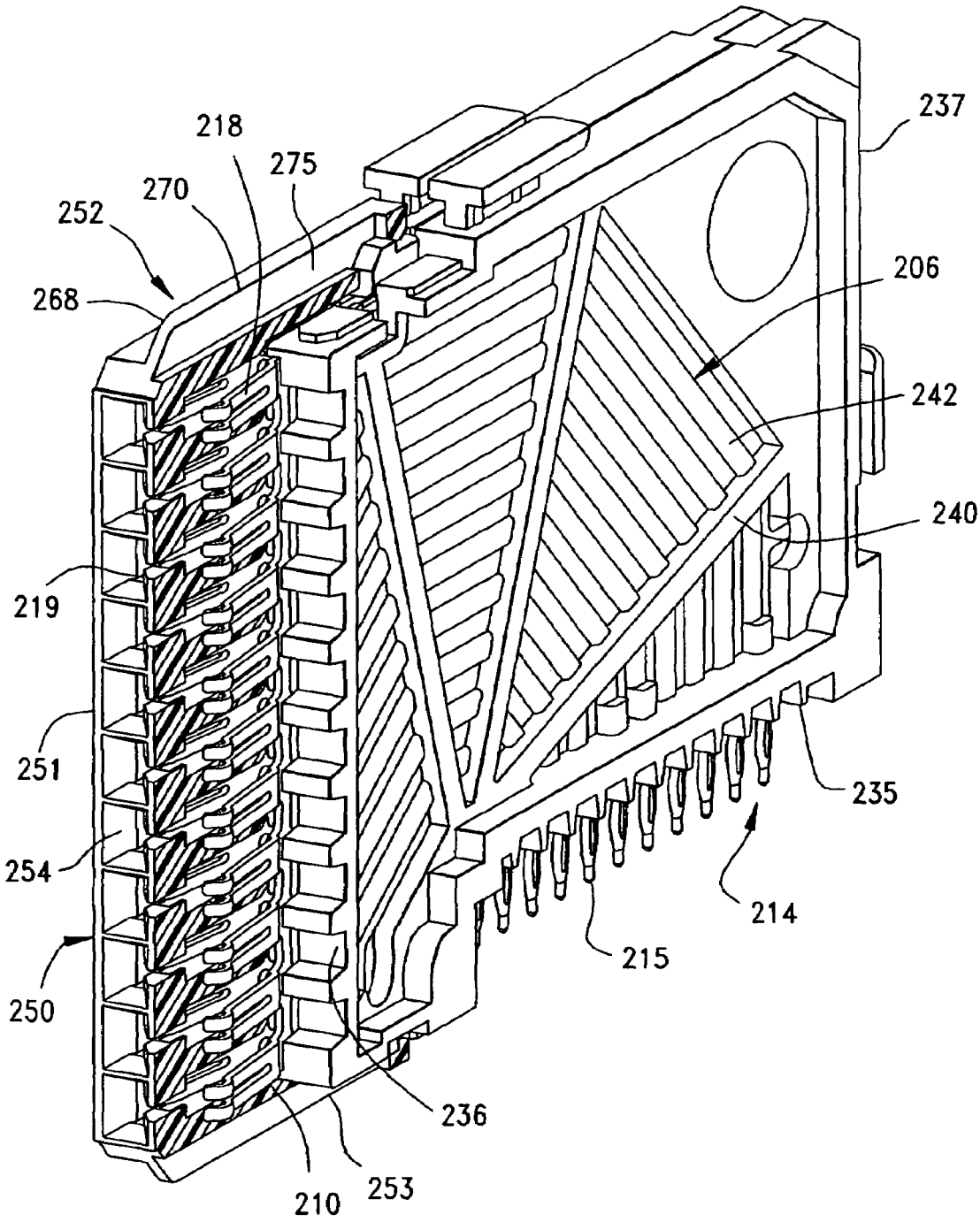
FIG. 11B is the same perspective view as FIG. 11, taken from the opposite side and sectioned along lines B—B of FIG. 11, illustrating how the terminal contact portions are contained within the interior cavities of the cover member.

As shown in FIG. 10, the cover member 250 may include a pair of channels 262, 263 that are disposed on opposite sides of a central rib 264 and which run for the length of the cover member 250. These channels 262, 263 engage and receive lugs 264 that are disposed along the top edge of the wafer connector component 202. The cover member arms 252, 253 also may contain a central slot 275 into which extends a retaining hook 276 that rises up from the top and bottom edges 234, 235 of the wafer connector component. The manner of engagement is illustrated in FIG. 11B and the cover member arms 252, 253 may be snapped into engagement or easily pried free of their engagement with the wafer connector component 202.

FIG. 12 illustrates the mating interface between the two connector components and it can be seen that the forward portion of the cover members 250 fit into the channels 110 of the backplane member 100. In doing so, the blade contact portions 122 of the backplane member terminals 120 will enter the cover member cavities 254 and the distal tips, i.e. the curved ends 219, of the dual beam contacts 217 will engage the inner surfaces 125 of the pairs of backplane member terminals 120. The backplane member terminal blade contact portions will then flex slightly outwardly against the inner walls of the cover member 250 and this contact ensures that the contact blades 122 will not deflect excessively. Additionally, the cover member 250 includes central walls 259 that flank the center air channel slots 257 and these walls 259 are angled and their angled surfaces meet with and contact the offset which is present in the backplane member terminal body portions 126. The ribs 130 of the terminal body portions 126 of the backplane member terminals 120 may be aligned with the air channel slots 257.

Figure 13A:
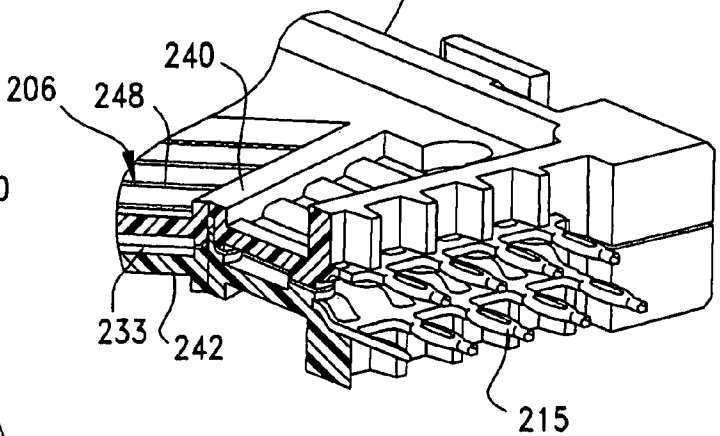
FIG. 13A is a partial sectional view of the wafer connector component of FIG. 11, taken along the angled line 13—13 thereof.
Figure 13B:
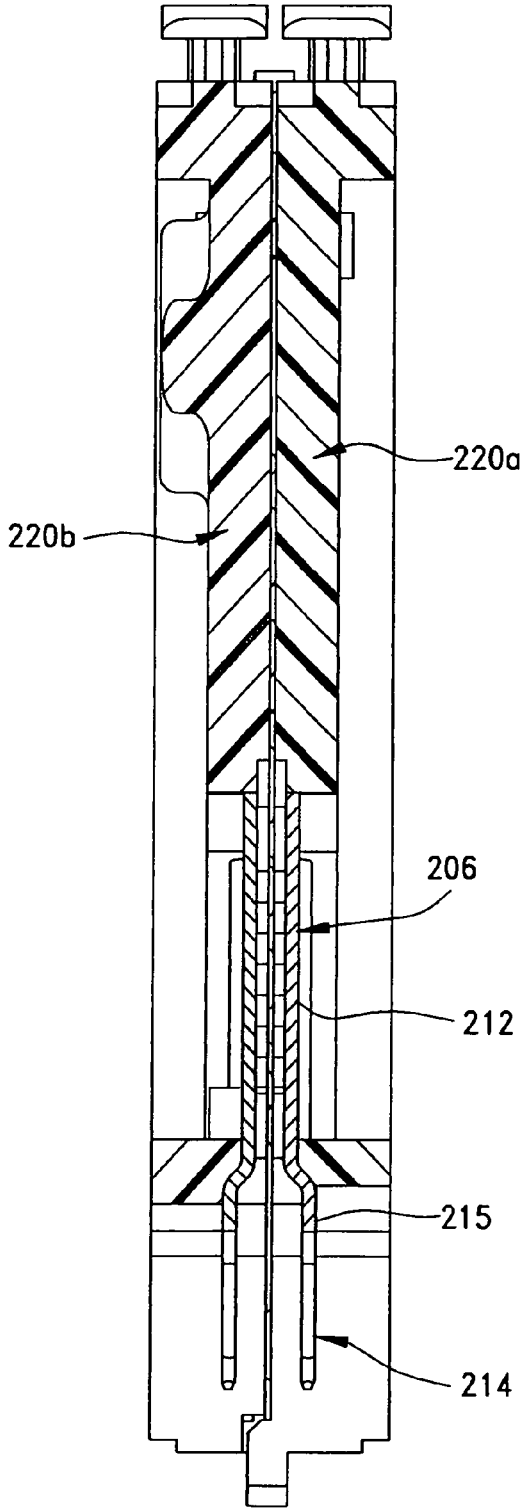
FIG. 13B is the same view as FIG. 13A, but taken directly from the front of the section shown in FIG. 13A.

FIG. 13 illustrates how the compliant portions 215 of the wafer connector component connector terminal tail portions 214 are spaced further apart in the tail area than in the body of the wafer connector component 202. The tail portions 214 are offset and the space between adjacent pairs of tails is left empty and is therefore filled with air. No wafer material extends between the pairs of terminal tails 214 so that the air gap that is present in the body of the wafer connector components is maintained at the mounting interface to the circuit board.

Figure 2:
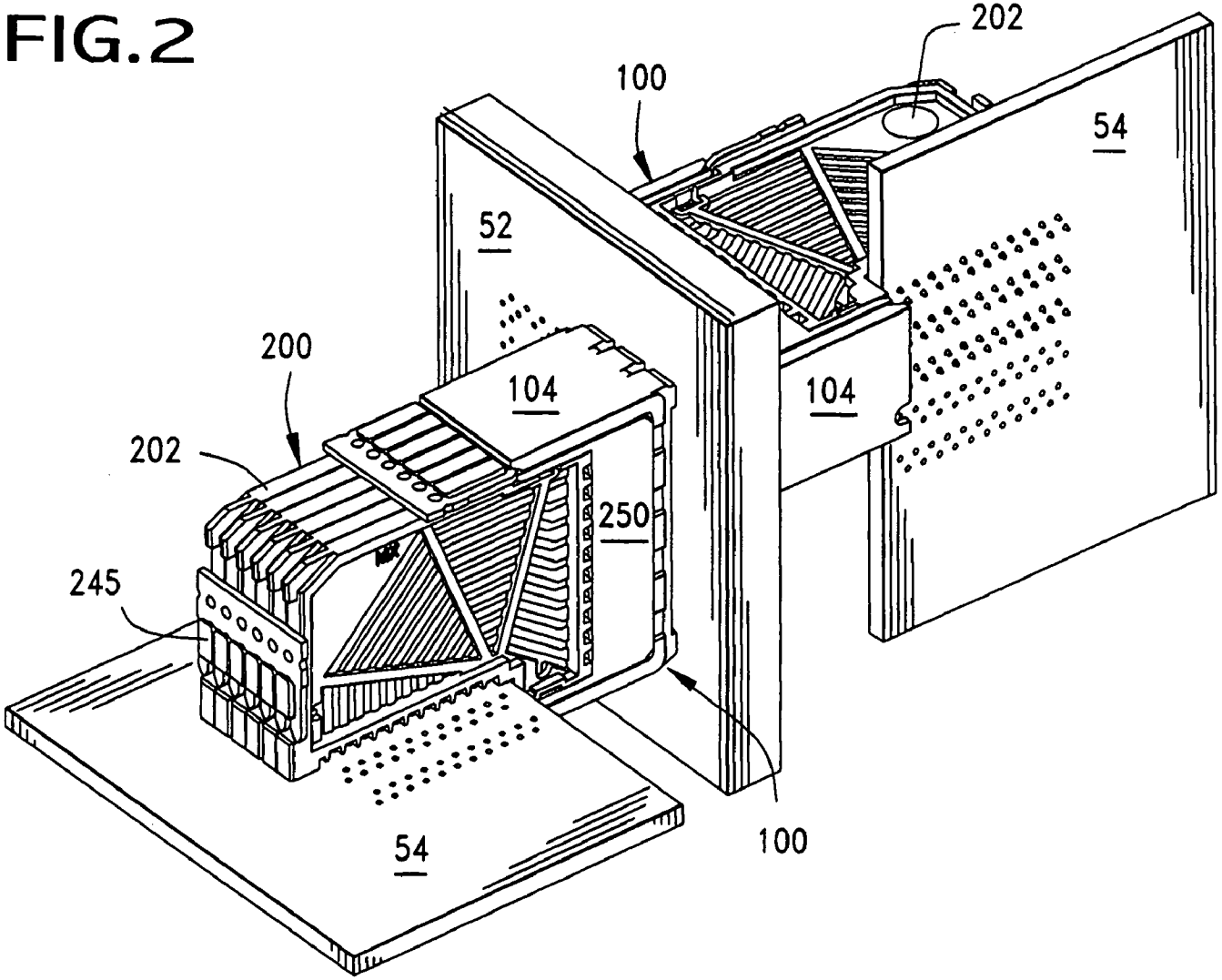
FIG. 2 is a perspective view of two backplane connectors of the present invention used in an orthogonal orientation to join circuits on two circuit boards together.

The terminal tails 214 are also offset in their alignment and this offset only encompasses the compliant tail portions 215. The openings in the legs of the H-shaped cavities 111 can be seen in FIG. 5A as including a slight offset. This is so that the terminals 120 need be only of one shape and size, and one row may be turned 180 degrees from the other row of terminals and inserted into the cavities 111. The body portions 126 and the blade contact portions 122 are not offset so the offset of the leg portions 126 of the terminal-receiving cavities 111 ensures that the flat contact blade and the (offset parts of the) body portions are aligned with each other to maintain coupling. Secondly, the tails are then offset from each other by about 45 degrees. This permits the use of a favorable via pattern on the mounting circuit board and permits the connector assembly to be used in orthogonal midplane applications, such as is shown in FIG. 2.

FIGS. 20–23 illustrate another embodiment 400 of the present invention with guide means integrated to the connector 405 and header members 450. In this embodiment, the header member 450 has a base portion 451 and two side walls 452 that rise up from the base portion 451. A guide portion 454 is formed with the header member and it can be seen to extend across the space between the two side walls 452 at an end 455 of the header member base portion 451. The guide portion 454 preferably includes at least one guide pin 457 that extends upwardly with respect to the base portion 451. It may also preferably include an angled wall 458 that is disposed adjacent to a support portion 459 from which the guide pins 457 extend.

Figure 21:
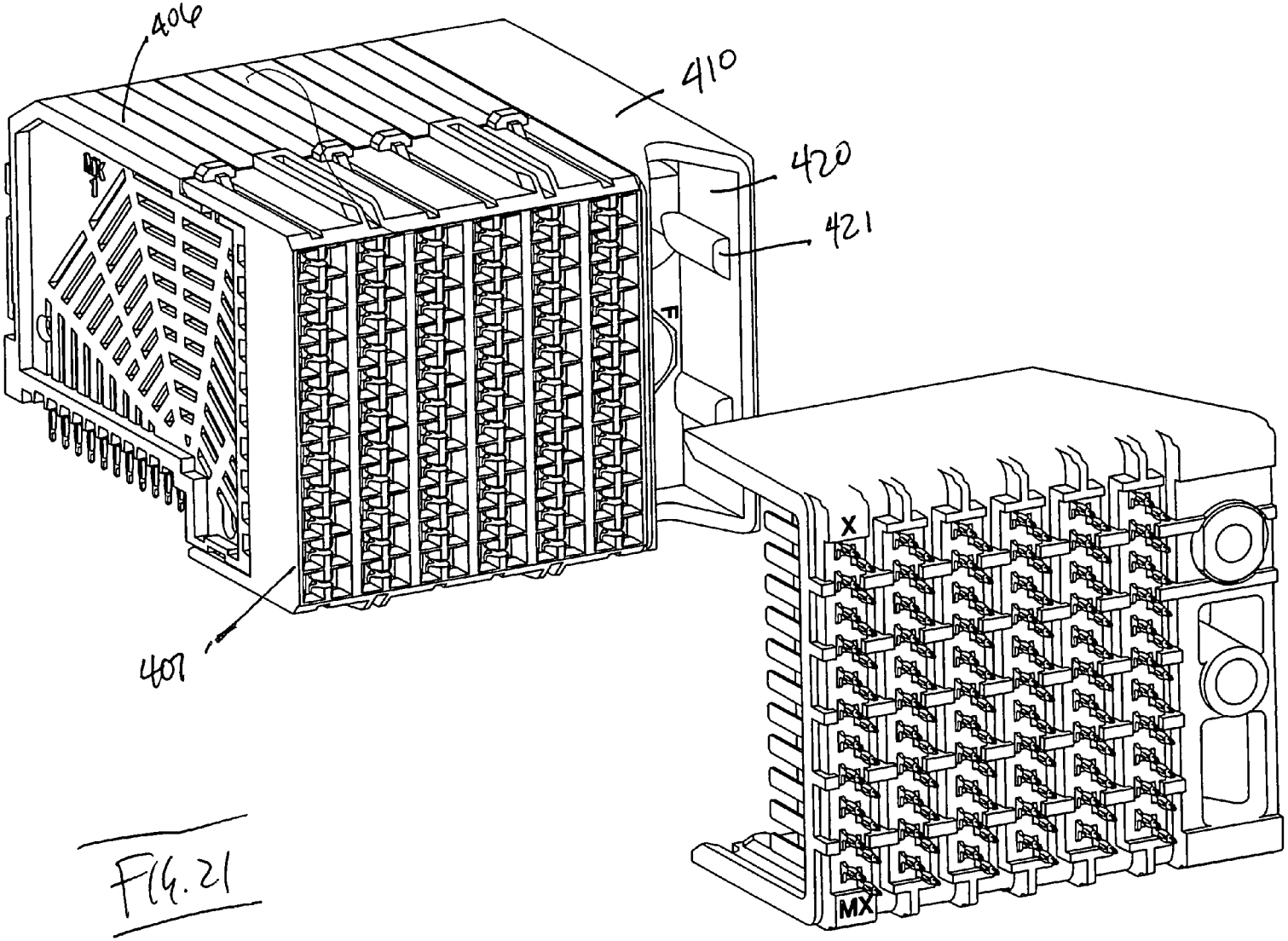
FIG. 21 is the same view as FIG. 20, but taken from the rear of the connector element assembly.
Figure 22:
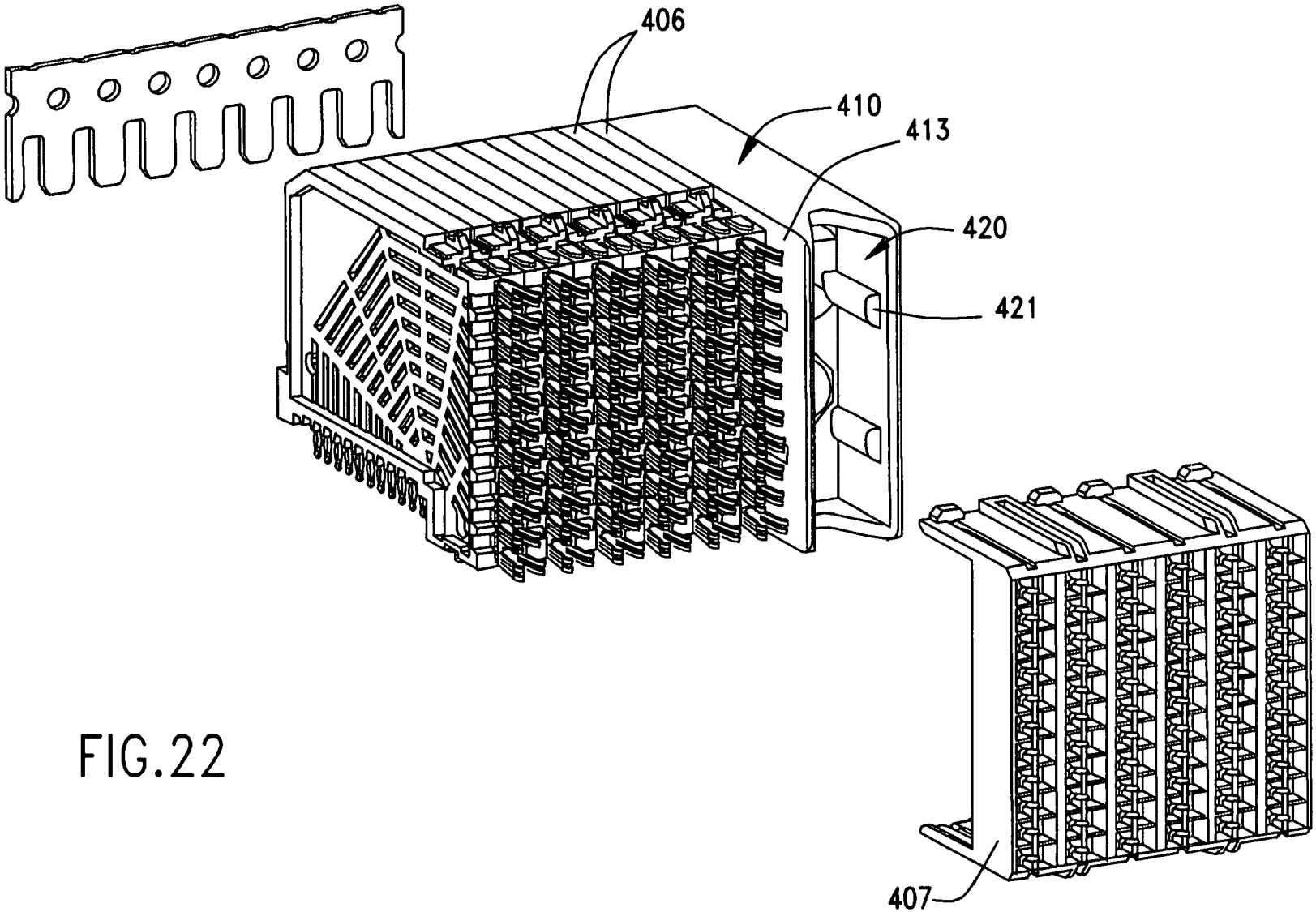
FIG. 22 is an exploded view of the connector element assembly of FIG. 21; and, FIG. 23 is a similar view to FIG. 22, but taken from the rear of the connector element assembly.
Figure 23:
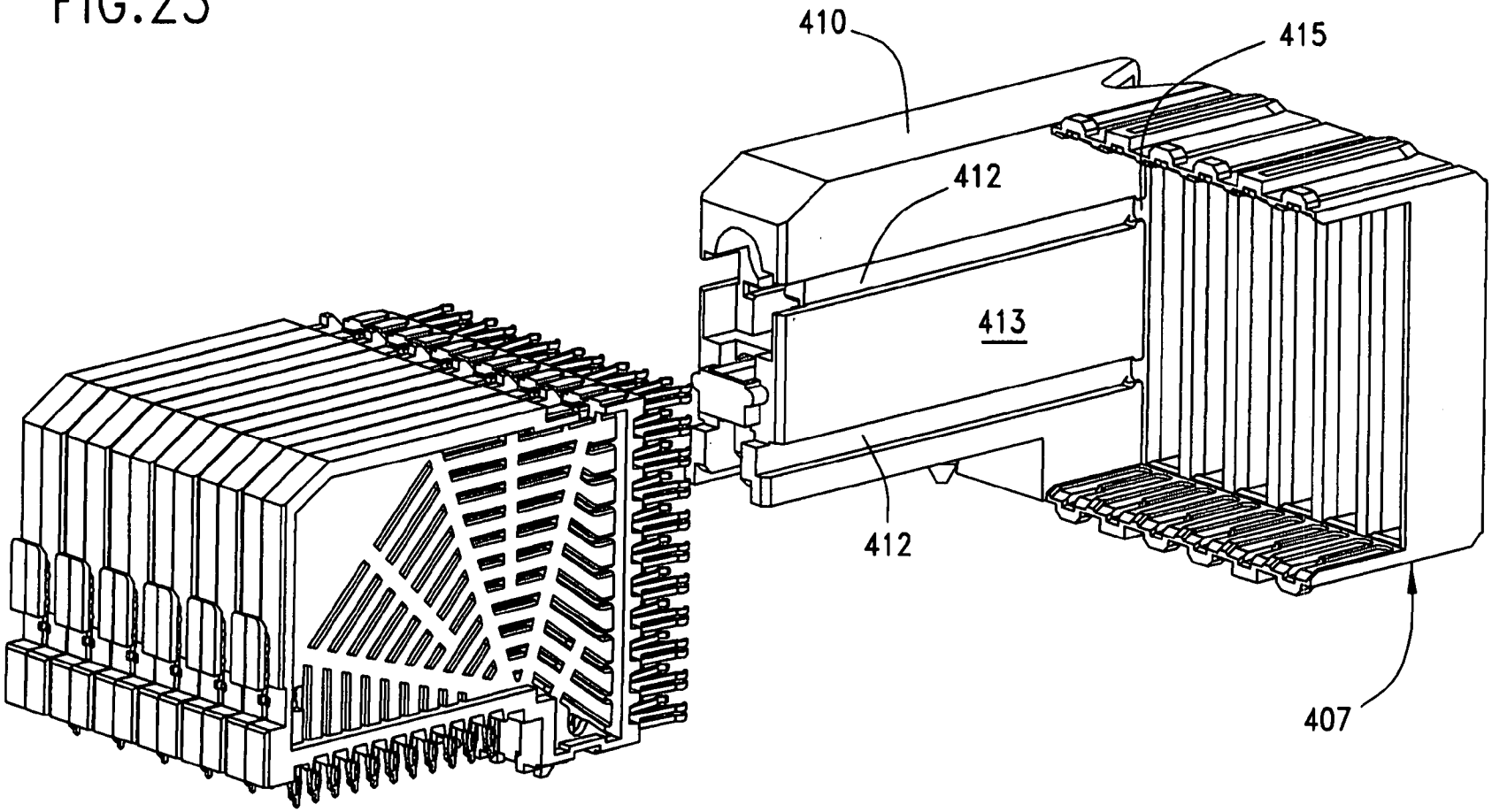

FIG. 21 best illustrates the guide means attached to the opposing connector 405. The connector 405 includes a plurality of wafer-style connector elements 406 as explained hereinabove, which fit into the hollow interior of a cover member 407. A guide block 410 is provided that engages the cover member 407. As shown in FIG. 23, the guide block has one or more guide tracks 412 that are formed in a sidewall 413 thereof and which extend from end to end of the guide block. These guide tracks 412 receive guide rails 415 that are formed in one side of the cover member 407, on the exterior surface thereof. The guide tracks 412 may be slightly tapered so as to ensure a solid an reliable by the guide rails 415.

The connector elements 406 are held within the cover member 407 in their ordinary manner described above and the guide block may be used by an installer to avoid stubbing the contact ends of the terminal when mating to the header member 450. The guide block 410 preferably includes a hollow interior 420 (FIG. 21) that receives the guide pins 457 and a leading (or top) portion of the guide support portion 459 and may also include stubs or protrusions 421 that engage the outer surfaces of the opposing guide and provide a frictional-type fit. With the use of such guide means, the connectors of the invention may be utilized in blind-mate applications. The guide block 410 preferably has a length that matches the lengths of the connector elements 406.

While the preferred embodiment of the invention have been shown and described, it will be apparent to those skilled in the art that changes and modifications may be made therein without departing from the spirit of the invention, the scope of which is defined by the appended claims.

We claim:

1. A high speed connector, comprising:

a plurality of wafer-style connector elements, each of the elements including an insulative housing taking the form of a skeletal network that supports a plurality of conductive terminals in a vertically aligned orientation, the network including housing material disposed between adjacent horizontal edges of the terminals that supports said terminal in said vertical orientation, vertical sides of said terminals being open to air, each of said wafer connector element housings including a rib that extends around a perimeter thereof and which extends transversely to a body portion of each housing so as to define a recess on each side of said wafer connector elements such that when two wafer connector elements are mounted adjacent to each other, an air cavity is defined therebetween, said terminal including termination portions at first ends thereof and contact portions at second ends thereof, the contact portions each including a pair of contact arms extend out from a body portion of a respective terminal;

a housing that receives front ends of said wafer connector elements and holds them in position for mating to a header, the housing including a plurality of slots that engage projections on said wafer connector elements, said housing including openings formed therein in alignment with said terminal contact portions, the openings having a H-configuration when viewed from a front end of said housing; and, a guide member adjacent the housing and extending rearwardly therefrom, the guide member including means for engaging said housing.

2. The connector of claim 1, wherein the guide block includes at least one track and said housing includes a rail that is received within said track.

3. The connector of claim 1, wherein the guide block has a length approximately equal to the length of said connector elements.

4. The connector of claim 1, wherein said guide member includes a guide block with a hollow interior.

5. The connector of claim 4, wherein the guide block includes at least one opening arranged to receive a guide pin from a guide portion of an opposing connector.

6. The connector of claim 4, wherein the guide block includes at least one opening arranged to receive a guide pin from a guide portion of an opposing connector.

7. A connector, comprising:

a plurality of connector elements, each of the elements including an insulative housing that supports a plurality of conductive terminals in a vertically aligned orientation, the terminals each including termination portions disposed along at first ends of said housings, and contact portions disposed along second ends of said housings, the contact portions each including a pair of contact arms extending out from a body portion of a respective terminal;

at least one hollow cover member that receives front ends of said connector elements and holds them together as a single unit for mating to a header, the one cover member including openings formed therein in alignment with said terminal contact portions, the openings receiving said connector element terminals therein; and, a guide member, the guide member including a plurality of sidewalls that cooperatively define a hollow interior portion that receives at least one guide pin and a base portion of an opposing connector guide element, one of said sidewalls including means for engaging said one cover member and holding said one cover member in place adjacent said connector elements, at least one of said sidewalls further including a protrusion disposed thereon within said hollow interior portion for creating a frictional-type fit with one opposing connector guide element inserted into when said opposing connector is mated to said connector.

8. The connector of claim 7, wherein said guide member includes an opening disposed in the hollow interior portion thereof for receiving a guide post of an opposing portion of a header connector.

9. The connector of claim 7, wherein said hollow interior is defined by a plurality of sidewalls and at least one of said sidewalls includes an angled surface thereon.

10. The connector of claim 7, wherein said guide member has a length equal to that of an adjacent connector element.

11. The connector of claim 7, wherein one of said guide member and cover member includes at least one guide track and the other of said guide member and cover member includes a guide rail that is received within said guide track.

12. The connector of claim 11, wherein said cover member includes at least one guide rail disposed thereon and said guide member includes at least one guide track disposed therein, the guide rail being slidably received within said guide track.

* * * * *